US011910922B2

(12) United States Patent
Paulick

(10) Patent No.: US 11,910,922 B2
(45) Date of Patent: Feb. 27, 2024

(54) MODULAR BOTTLE RACK SYSTEM AND RACK COMPONENT THEREOF

(71) Applicant: WineHive, Inc., San Luis Obispo, CA (US)

(72) Inventor: John F. Paulick, San Luis Obispo (CA)

(73) Assignee: WINEHIVE, INC.

( * ) Notice: Subject to any disclaimer, the term of this patent is extended or adjusted under 35 U.S.C. 154(b) by 0 days.

(21) Appl. No.: 17/845,303

(22) Filed: Jun. 21, 2022

(65) Prior Publication Data

US 2022/0408917 A1 Dec. 29, 2022

Related U.S. Application Data

(60) Provisional application No. 63/213,802, filed on Jun. 23, 2021.

(51) Int. Cl.

| | |
|---|---|
| ***A47B 73/00*** | (2006.01) |
| ***A47F 7/00*** | (2006.01) |
| ***A47F 7/28*** | (2006.01) |

(52) U.S. Cl.

CPC ..... *A47B 73/006* (2013.01); *A47B 73/004* (2013.01); *A47F 7/0035* (2013.01); *A47F 7/283* (2013.01)

(58) Field of Classification Search

CPC ... A47B 73/006; A47B 73/004; A47B 73/008; A47F 7/28; A47F 7/283; A47F 7/0028; A47F 7/0035; A47G 23/0241

USPC ..... 211/74, 75; D7/701, 707

See application file for complete search history.

(56) References Cited

U.S. PATENT DOCUMENTS

| | | | | |
|---|---|---|---|---|
| 1,525,970 A * | 2/1925 | Wildberg | B65D 85/305 211/74 |
| RE22,507 E * | 6/1944 | Heigis | F17C 13/084 211/75 |
| 2,577,120 A * | 12/1951 | Franz | F28D 1/00 52/592.4 |

(Continued)

FOREIGN PATENT DOCUMENTS

| | | |
|---|---|---|
| CN | 2546363 | 4/2003 |
| CN | 201536810 | 8/2010 |
| EP | 1997401 A2 | 12/2008 |

OTHER PUBLICATIONS

FlyWithWine Website, WineHive Cell Modern ModularWine Storage System, https://www.flywithwine.com/products/winehive-cell-modern-modular-wine-storage-system., Retrieved Jun. 6, 2022, pp. 1-2.

(Continued)

*Primary Examiner* — Jennifer E. Novosad
(74) *Attorney, Agent, or Firm* — The Belles Group, P.C.

(57) ABSTRACT

A modular bottle rack system which includes a plurality of rack components. Each of the rack components may include a first receptacle and a second receptacle facing in opposite direction. The rack components may have S-shaped transverse cross-sectional areas. The rack components may also include connection features designed to enable the various rack components to be coupled together. The rack components may be able to be stacked with each rack component nesting within the rack component above and/or below. The system may also include mounting brackets for mounting the bottle rack to a wall in various different configurations.

3 Claims, 31 Drawing Sheets

(56) References Cited

U.S. PATENT DOCUMENTS 2,975,908 A * 3/1961 Huet ..... A47B 96/028 248/250
3,194,426 A * 7/1965 Brown, Jr. ..... B65D 21/0204 222/143
3,643,813 A * 2/1972 Noonan ..... A47B 73/00 211/75
3,746,178 A * 7/1973 Wagschal ..... A47B 73/006 220/23.6
D236,411 S * 8/1975 Horney ..... D6/683
4,093,076 A * 6/1978 Newton ..... A47B 73/006 211/74
D252,550 S * 8/1979 Johnson ..... D7/708
4,199,070 A * 4/1980 Magnussen, Jr. .... A47B 73/006 248/68.1
4,205,629 A * 6/1980 Wix ..... A01K 5/0114 D6/558
4,262,467 A * 4/1981 Faisant ..... F16S 5/00 52/311.2
4,270,662 A * 6/1981 Gonzalez ..... A47B 73/006 211/186
4,422,555 A * 12/1983 Jacobs ..... A47B 73/006 211/74
D272,699 S * 2/1984 Godfrey ..... 211/74
4,550,539 A * 11/1985 Foster ..... A47B 73/006 52/844
4,567,989 A 2/1986 Hurst, Jr.
4,660,727 A * 4/1987 Levine ..... A47B 73/006 211/74
D289,716 S * 5/1987 Boland, II ..... D7/701
4,795,038 A 1/1989 Johnson
D300,293 S * 3/1989 Casey ..... D7/708
4,848,856 A * 7/1989 Dyment ..... G07F 11/54 211/49.1
D317,991 S * 7/1991 Wightman ..... D7/708
5,401,301 A * 3/1995 Schulmerich ..... F16L 9/19 96/72
5,947,305 A * 9/1999 Lin ..... A47B 73/006 211/74
D421,370 S * 3/2000 Hints ..... D7/701
D446,092 S * 8/2001 Cautereels ..... D7/701
6,290,074 B1 * 9/2001 Syvuk ..... A47F 7/283 D7/619.1
6,435,355 B1 * 8/2002 Brown ..... A47B 73/006 211/74
6,523,705 B2 * 2/2003 Henderson ..... A47G 23/0241 211/74
D479,786 S * 9/2003 Matheou ..... D7/701
7,004,336 B2 * 2/2006 Dagan ..... A47B 73/006 211/74
D525,091 S * 7/2006 Baxter ..... D7/701
7,131,544 B1 * 11/2006 Cunningham ..... A47B 73/006 206/139
7,287,653 B2 * 10/2007 Rhodes ..... A47B 47/0066 211/74
D569,655 S * 5/2008 Williams ..... D6/682.2
7,604,133 B2 * 10/2009 Tsai ..... A47B 73/006 211/189
7,984,806 B2 * 7/2011 Matheou ..... A47B 73/008 206/427
8,248,792 B2 * 8/2012 Wei ..... H05K 7/1497 181/283
8,439,209 B2 * 5/2013 Strollo ..... A47B 81/00 211/75
D701,436 S * 3/2014 Paulick ..... D7/701
8,662,326 B2 * 3/2014 Brick ..... A47B 47/042 211/186
9,038,834 B2 * 5/2015 Liu ..... A47B 87/02 211/186
D731,866 S 6/2015 Paulick
9,303,791 B2 * 4/2016 Masters ..... B63B 25/08
9,320,355 B2 * 4/2016 Lee ..... A47B 47/0091
D780,540 S * 3/2017 Koziol ..... D7/701
D796,344 S * 9/2017 Paulick ..... D25/115
D811,176 S * 2/2018 Paulick ..... D7/701
D816,437 S * 5/2018 Kendall ..... D7/701
10,178,908 B1 * 1/2019 Tseng ..... A47B 47/021
10,244,866 B2 * 4/2019 Pollard ..... A47B 47/0066
10,561,238 B1 * 2/2020 Gutierrez ..... A47F 7/283
10,980,341 B1 * 4/2021 Van Pelt ..... A47B 73/006
D984,863 S * 5/2023 Dai ..... D7/701
2002/0036178 A1 * 3/2002 Tombu ..... B65G 1/02 211/74
2003/0205543 A1 * 11/2003 Kao ..... A47B 47/0016 211/74
2003/0205544 A1 11/2003 Rhodes
2004/0238467 A1 * 12/2004 Tully ..... A47B 73/006 211/74
2005/0011843 A1 1/2005 Dagan
2006/0005497 A1 * 1/2006 Foell ..... E04B 2/8629 52/589.1
2006/0096942 A1 * 5/2006 Lane ..... B65D 21/0231 215/10
2006/0261063 A1 * 11/2006 Dyehouse ..... B65D 21/0231 220/23.4
2007/0108144 A1 * 5/2007 Flick ..... C12H 1/16 211/74
2008/0217275 A1 * 9/2008 Chen ..... A47B 87/0276 211/194
2009/0090647 A1 * 4/2009 Panchal ..... B65D 21/0231 206/509
2013/0008864 A1 * 1/2013 Davis ..... A47B 73/006 211/74
2013/0341295 A1 12/2013 Dixon
2015/0076091 A1 3/2015 Lee
2015/0201750 A1 * 7/2015 Hopkins ..... A47B 73/008 211/75
2016/0120307 A1 * 5/2016 Salani ..... B65D 5/4204 211/74
2016/0309891 A1 * 10/2016 van Leeuwen ..... A47B 73/006
2018/0146776 A1 * 5/2018 Lye ..... A47B 47/0091
2018/0295984 A1 10/2018 Somers
2019/0082831 A1 * 3/2019 Smith ..... A47B 73/006
2022/0408917 A1 * 12/2022 Paulick ..... A47F 7/0035

OTHER PUBLICATIONS

FlyWithWine Website, WineHive Wall Mounting Kits, https://www.flywithwine.com/products/winehive-wall-mounting-kits., Retrieved Jun. 6, 2022, pp. 1-2.
International Search Report and Written Opinion of PCT/US2022/034263, dated Nov. 18, 2022.

* cited by examiner

MODULAR BOTTLE RACK SYSTEM AND RACK COMPONENT THEREOF

CROSS-REFERENCE TO RELATED APPLICATION

This application claims the benefit of priority from U.S. Provisional Application No. 63/213,802, filed Jun. 23, 2021, the contents of which are hereby incorporated herein by reference in their entirety.

BACKGROUND

Racks that support bottles, such as wine and other liquid containing bottles, come in many different forms. The general idea for such racks is that they should be capable of adequately supporting a desired number of the bottles while potentially also being aesthetically pleasing. However, many such racks are designed so that it is difficult for the user to identify each bottle without first removing the bottle from the rack. This can result in a time consuming process for a user to locate a particular bottle if the user does not know exactly where that bottle is located within the rack. Furthermore, such racks are often large structures that are either shipped assembled at a high cost, or take significant effort for the consumer to assemble on location. Thus, a need exists for a bottle rack and components thereof that address the aforementioned deficiencies.

BRIEF SUMMARY

The invention may be directed to a modular bottle rack system which includes a plurality of rack components. Each of the rack components may include a first receptacle and a second receptacle facing in opposite direction. The rack components may have S-shaped transverse cross-sectional areas. The rack components may also include connection features designed to enable the various rack components to be coupled together. The rack components may be able to be stacked with each rack component nesting within the rack component above and/or below. The system may also include mounting brackets for mounting the bottle rack to a wall in various different configurations.

In one aspect, the invention may be a modular bottle rack system comprising: a plurality of rack components each comprising: a first portion that defines a first receptacle facing in a first direction; a second portion that defines a second receptacle adjacent to the first receptacle and facing in a second direction that is opposite the first direction; and at least one connection feature; wherein the plurality of rack components are configured to be arranged in a stack so that: the first portion of an upper rack component nests within the first receptacle of a lower rack component positioned immediately below the upper rack component and the second portion of the lower rack component nests within the second receptacle of the upper rack component; or the first portion of the upper rack component nests within the second receptacle of the lower rack component and the first portion of the lower rack component nests within the second receptacle of the upper rack component; and wherein the plurality of rack components are configured to be coupled together via engagement between the at least one connection features to form a bottle rack whereby the first receptacle of a first one of the plurality of rack components and the second receptacle of a second one of the plurality of rack components form a cavity that is configured to hold a bottle positioned therein.

In another aspect, the invention may be a rack component of a modular bottle rack system, the rack component comprising: a monolithic body comprising a first end, a second end, and a longitudinal axis extending between the first and second ends, the monolithic body defining: a first receptacle comprising a first floor; and a second receptacle adjacent to the first receptacle and comprising a second floor, the first floor of the first receptacle and the second floor of the second receptacle facing in opposite directions; and wherein the monolithic body has an S-shaped transverse cross-sectional area.

In yet another aspect, the invention may be a modular bottle rack system comprising: a plurality of rack components that are configured to be coupled together in a variety of different configurations to form a bottle rack, each of the rack components comprising: a hexagonal body having an inner surface that defines a cavity configured to hold at least one bottle and an outer surface opposite the inner surface, a plurality of windows in the hexagonal body through which a label of the at least one bottle that is positioned within the cavity is visible; and a plurality of connection features that facilitate the coupling of the plurality of rack components together; and at least one mounting bracket configured to be mounted to a wall and coupled to one of the plurality of rack components to mount the bottle rack to the wall.

In a further aspect, the invention may be a modular bottle rack system comprising: a plurality of rack components that are configured to be coupled together in a variety of different configurations to form a bottle rack, each of the rack components comprising: a body having an inner surface that defines a cavity configured to hold at least one bottle and an outer surface opposite the inner surface, the cavity extending along a cavity axis, a plurality of windows in the body through which a label of the at least one bottle that is positioned within the cavity is visible; and a plurality of connection features that facilitate the coupling of the plurality of rack components together to form the bottle rack; at least one mounting bracket configured to be mounted to a wall and slidably engaged with one of the plurality of connection features of one of the rack components to couple the bottle rack to the at least one mounting bracket that is mounted to the wall; and wherein when the bottle rack is mounted to the wall, the cavity axis of each of the rack components is parallel to the wall so that the at least one bottle held in the cavity is in a label-forward orientation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
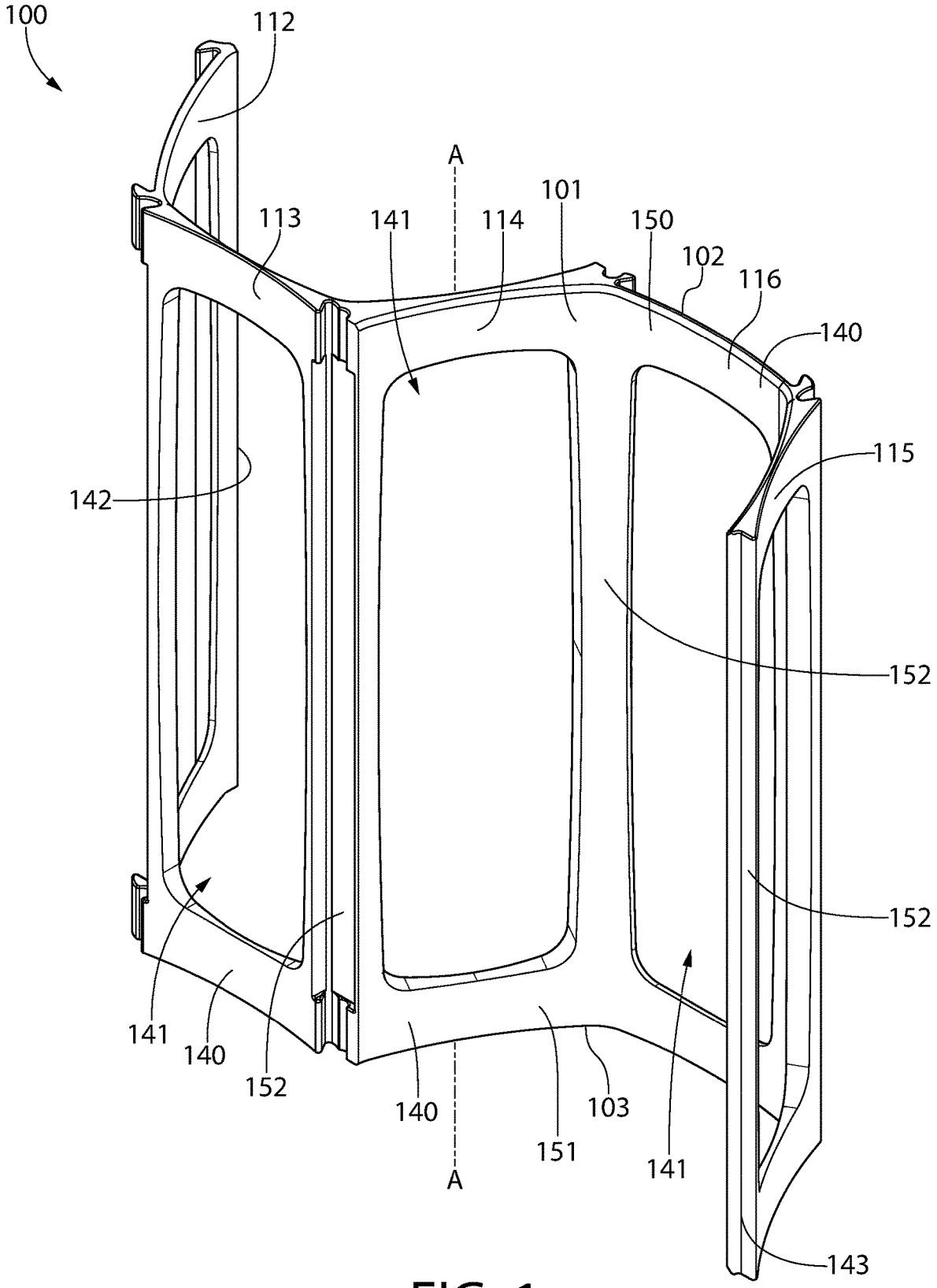
FIG. 1 is a front perspective view of a rack component of a bottle rack system in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
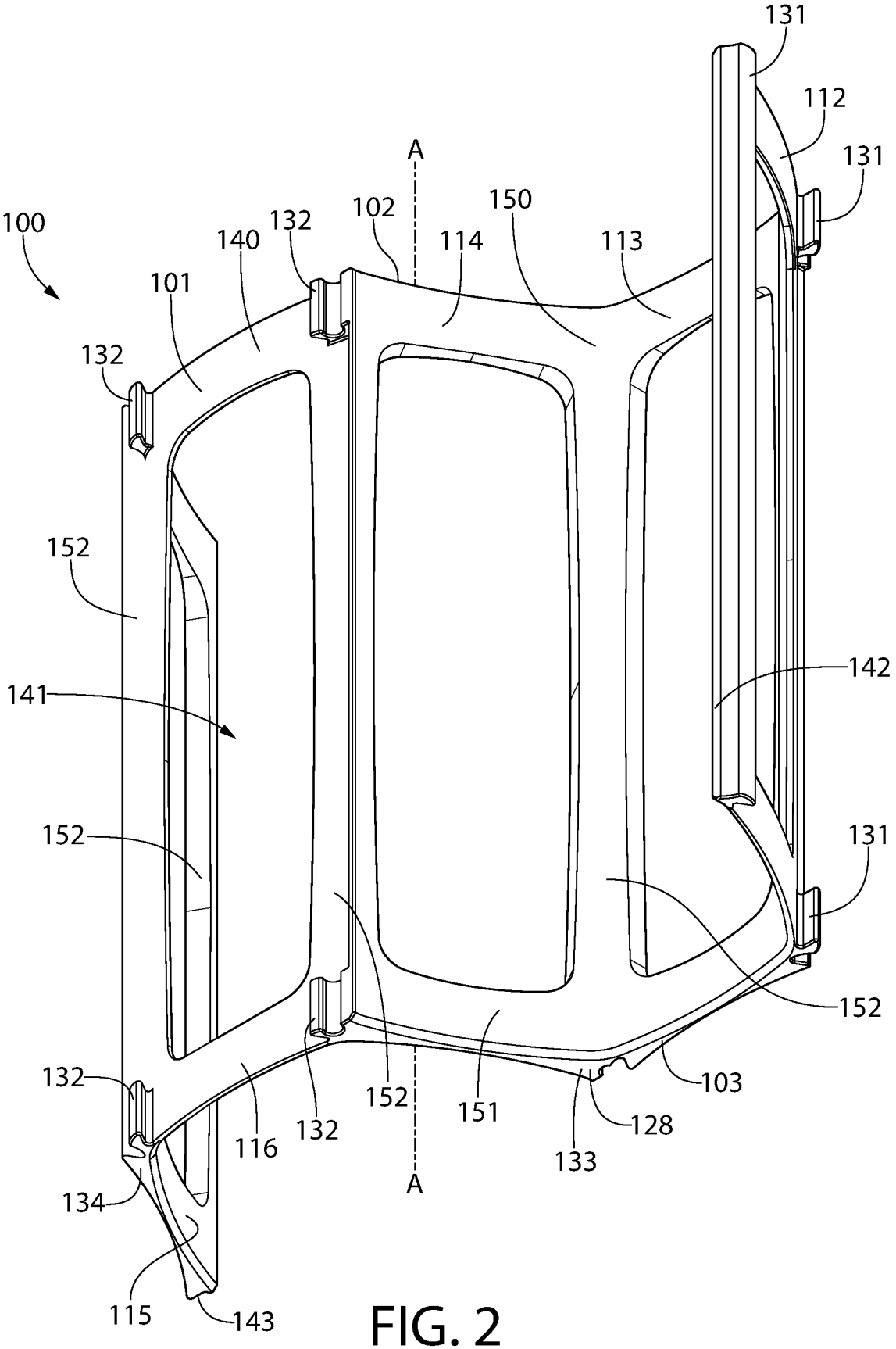
FIG. 2 is a rear perspective view of the rack component of FIG. 1.
Figure 3:
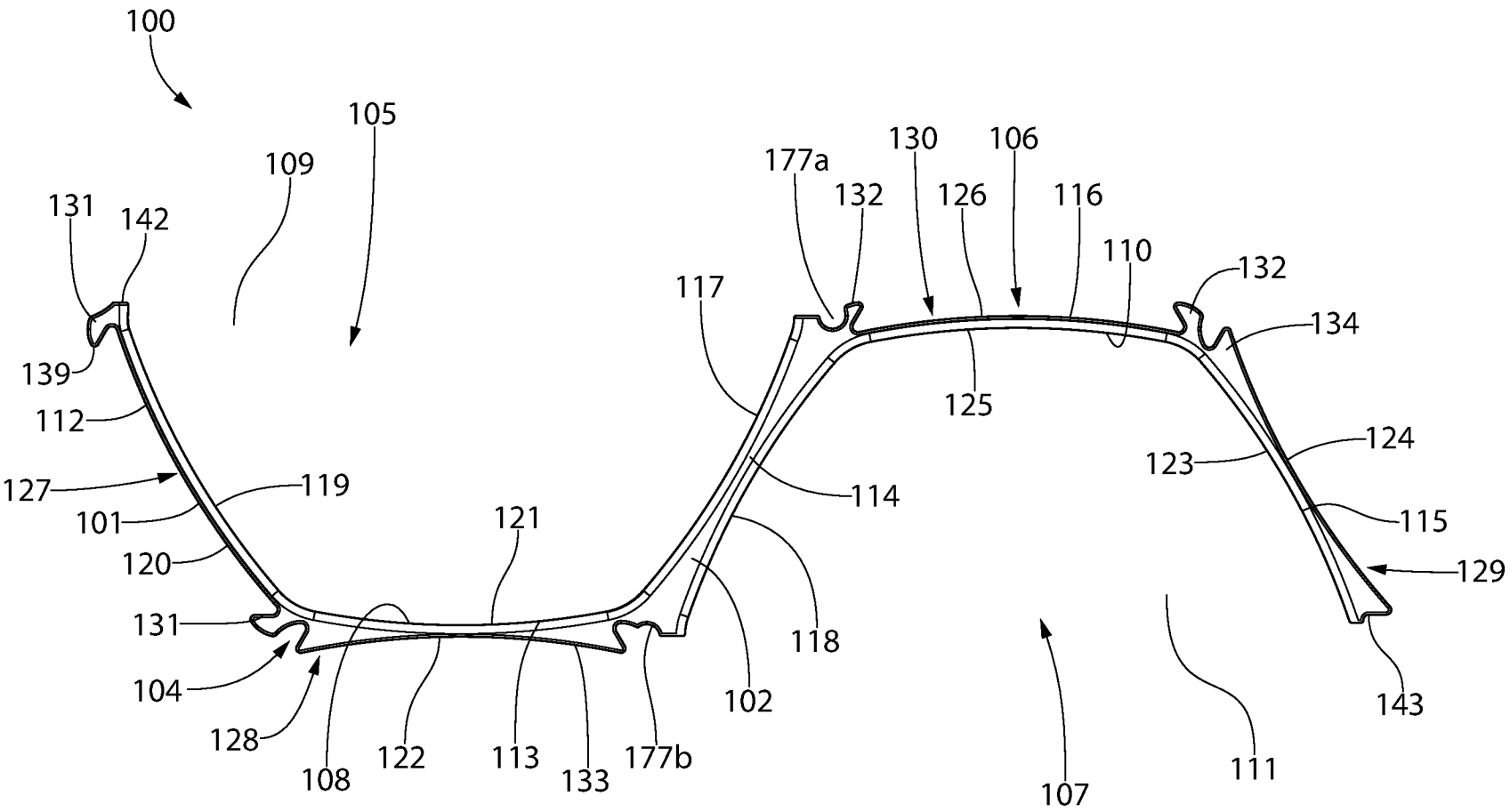
FIG. 3 is a front view of the rack component of FIG. 1.

Referring to FIGS. 1-3, a rack component 100 is illustrated. A plurality of the rack components 100 may be coupled together to form a bottle rack. The rack components 100 may be coupled together in a plurality of different configurations. Thus, the rack components 100 may be used to form bottle racks having different shapes and sizes, depending on the number of rack components 100 used and the manner in which they are coupled together. Thus, the rack components 100 may form part of a modular bottle rack system, in that the rack components 100 may be coupled together to form a bottle rack with modular shape. The system may also include various mounting brackets for mounting the bottle rack to a wall, as will be described herein.

The rack component 100 comprises a body 101 which is formed as a singular, unitary, monolithic structure. The body 101 may be formed from metal such as aluminum, brass, copper, steel, stainless steel, or the like. However, the invention is not to be so limited and other materials may be used in other embodiments, such as hard plastic materials like polypropylene, polyurethane, acrylonitrile-Butadiene-Styrene (ABS), polyvinyl chloride, polyethylene, or the like. The body 101 extends from a first end 102 to a second end 103 along a longitudinal axis A-A. The body also comprises a first side edge 142 extending between the first and second ends 102, 103 and a second side edge 143 extending between the first and second ends 102, 103. The body extends from the first side edge 142 to the second side edge 143 along an axis that is transverse to the longitudinal axis A-A. The body may have an S-shaped transverse cross-sectional area. Stated another way, when the body 101 is viewed from a front or rear elevation view (such as is shown in FIG. 3), the body 101 may have an S-shape.

The body 101 of the rack component 100 comprises a first portion 104 that defines a first receptacle 105 and a second portion 106 that defines a second receptacle 107. The first receptacle 105 comprises a floor 108 and an open top end 109. The second receptacle 107 comprises a floor 110 and an open top end 111. The first receptacle 105 faces in a first direction and the second receptacle 107 faces in a second direction that is opposite the first direction. Thus, the first receptacle 105 may extend from the floor 108 to the open top end 109 moving in a first direction and the second receptacle 107 may extend from the floor 110 to the open top end 111 moving in a second direction that is opposite the first direction. As such, the floor 108 of the first receptacle 105 is side-by-side adjacent to the open top end 111 of the second receptacle 107 and the floor 110 of the second receptacle 107 is side-by-side adjacent to the open top end 109 of the first receptacle 105. Thus, if the rack component 100 is positioned on a horizontal surface such as a tabletop or the like with the longitudinal axis A-A parallel to the horizontal surface, one of the first and second receptacles 105, 107 will face downwardly towards the horizontal surface and the other one of the first and second receptacles 105, 107 will face upwardly away from the horizontal surface.

The first receptacle 105 extends along a first receptacle axis that is parallel to the longitudinal axis A-A and the second receptacle 107 extends along a second receptacle axis that is parallel to the longitudinal axis A-A. Each of the first and second receptacles 105, 107 may be U-shaped. The U-shape may be curved as shown or more squared in different embodiments. The shape and size of the receptacle 105 should be designed so that a bottle can be stored therein. However, the exact shape of the first and second receptacles 105, 107 is not to be limiting of the invention in all embodiments.

The first portion 104 of the rack component 100 comprises a first wall 112, a second wall 113, and a common wall 114. The first wall 112 comprises the first side edge 142 and the second wall 113 is located between the first wall 112 and the common wall 114. The second portion 106 of the rack component 100 comprises a third wall 115, a fourth wall 116, and the common wall 114. The third wall 115 comprises the second side edge 143 and the fourth wall 116 is located between the third wall 115 and the common wall 114.

The common wall 114 may extend between the second wall 113 and the fourth wall 116. The common wall 114 comprises a first surface 117 and a second surface 118 opposite the first surface 117. The first and second surfaces 117, 118 of the common wall 114 may both be concave. The first surface 117 of the common wall 114 defines a portion of the first receptacle 105. The second surface 118 of the common wall 114 defines a portion of the second receptacle 107. The first wall 112 comprises a first surface 119 that defines a portion of the first receptacle 105 and a second surface 120 opposite the first surface 119 and the second wall 113 comprises a first surface 121 that defines a portion of the first receptacle 105 and a second surface 122 opposite the first surface 121. The third wall 115 comprises a second surface 123 that defines a portion of the second receptacle 107 and a first surface 124 opposite the first surface 123 and the fourth wall 116 comprises a second surface 125 that defines a portion of the second receptacle 107 and a first surface 126 opposite the first surface 125. Thus, the first surfaces 119, 121, 117 of the first, second, and common walls 112, 113, 114 define the floor 108 of the first receptacle 105 and the second surfaces 123, 125, 118 of the third, fourth, and common walls 115, 116, 114 define the floor 110 of the second receptacle 107. It should be noted that the first surfaces 119, 121, 117, 126, 124 of each of the walls face in the same general direction and the second surfaces 120, 122, 118, 125, 123 of the walls face in the same general direction (opposite the first surfaces). The first surfaces 119, 121, 117, 126, 124 collectively form an S-shape and the second surfaces 120, 122, 118, 125, 123 also collectively form an S-shape.

The rack component 100 further comprises at least one connection feature. In the exemplified embodiment, the rack component 100 comprises a plurality of connection features, as detailed herein. Each of the first, second, third, and fourth walls 112, 113, 115, 116 may comprise a connection feature and the common wall 114 may not comprise a connection feature. More specifically, the first wall 112 may comprise a connection feature 127, the second wall 113 may comprise a connection feature 128, the third wall 115 may comprise a connection feature 129, and the fourth wall 116 may comprise a connection feature 130. The connection features 127 may be located on the second surface 120 of the first wall 112, the connection feature 128 may be located on the second surface 122 of the second wall 113, the connection feature 129 may be located on the first surface 124 of the third wall 115, and the connection feature 130 may be located on the first surface 126 of the fourth wall 116.

The connection features 127, 130 of the first and fourth walls 112, 116 may be a first type of connection feature and the connection features 128, 129 of the second and third walls 113, 115 may be a second type of connection feature. The first type of connection feature may be a female connection feature and the second type of connection feature may be a male connection feature that is configured to slidably engage with the first type of connection feature to couple two or more of the rack components 100 together (or vice versa) The first type of connection feature may comprise a socket of a dovetail joint and the second type of connection feature may comprise a pin of the dovetail joint. The first and second types of connection features of two separate ones of the rack components 100 may be slidably coupled together to form a dovetail joint connection. Of course, other types and styles of connection features may be used in other embodiments. In some embodiments it is merely preferred that two of the rack components 100 are configured to be coupled together via slidably mating the first type of connection feature of one of the rack components 100 with the second type of connection feature of the other of the rack components 100.

The connection feature 127 of the first wall 112 may comprise two pairs of tabs 131 protruding from the second surface 120 of the first wall 112 in a spaced apart manner. Alternatively, there may be a single pair of tabs that runs the full length of the first wall 112 from the first end 102 to the second end 103, or at least one of the tabs 131 of the pairs may run the full length of the first wall 112. The tabs 131 of each pair may have angled inner surfaces that face one another to define a trapezoidal shaped recess therebetween (best seen in FIG. 3). The tabs 131 may comprise locking protuberances 139 that extend inwardly towards one another. Furthermore the second surface 120 of the first wall 112 may be convex. Similarly, the connection feature 130 of the fourth wall 116 may comprise two pairs of tabs 132 protruding from the first surface 126 of the fourth wall 116 in a spaced apart manner. The tabs 132 of each pair may have angled inner surfaces that face one another to define a trapezoidal shaped recess. Furthermore, the first surface 126 of the fourth wall 116 may be convex.

The connection feature 128 of the second wall 113 may comprise a protruding body 133 extending from the second surface 122 of the second wall 113. The protruding body 133 may have a trapezoidal shape with a concave outer surface. The connection feature 129 of the third wall 115 may comprise a protruding body 134 extending from the first surface 124 of the third wall 115. The protruding body 134 may have a trapezoidal shape with a concave outer surface. The protruding bodies 133, 134 may be configured to slidably fit within the trapezoidal shaped recesses of the connection features 127, 130 to create the interlock between two or more of the rack components 100. The concave outer surfaces of the protruding bodies 133, 134 of one of the rack components 100 may interface with the second surface 120 (which is convex) of the first wall 112 or the first surface 126 (which is convex) of the fourth wall 116 of another one of the rack components 100 when the two rack components 100 are coupled together.

Each of the first, second, third, fourth, and common walls 112-116 may comprise a rectangular shaped frame portion 140 that surrounds an opening which forms a window 141. A majority of each of the first, second, third, fourth, and common walls 112-116 may be taken up by the window 141. That is, the window 141 may form between 60% and 80% of each of the first, second, third, fourth, and common walls 112-116. This results in a significant decrease in material costs, while also providing that the label on the bottle stored on the rack component 100 may be visible to a user so that the user need not remove the bottle from the rack entirely to determine what bottle it is.

The rack component 100 may comprise a first end portion 150 which comprises the first end 102 and a second end portion 151 which comprises the second end 103. Each of the first and second end portions 150, 151 may extend from the first side edge 142 to the second side edge 143. Each of the first and second end portions 150, 151 may be S-shaped. The rack component 100 may further comprise a plurality of struts 152 that extend from the first end portion 150 to the second end portion 151. Each of the windows 141 may be defined between portions of each of the first and second end portions 150, 151 and between two adjacent ones of the struts 152.

In the exemplified embodiment, the tabs 131, 132 of the first and fourth connection features 127, 130 may be located only along the first and second end portions 150, 151, but not along the struts 152. That is, the tabs 131 may comprise a pair of tabs on the first end portion 150 and a pair of tabs on the second end portion 151 and the tabs 132 may comprise a pair of tabs on the first end portion 150 and a pair of tabs on the second end portion 151. The tabs 131, 132 may extend along the struts 152 in other embodiments. Similarly, the protruding bodies 133, 134 may also be located only along the first and second end portions 150, 151, but not the struts 152, although they may be located along the struts 152 in other embodiments. Thus, in some embodiments the connection features are located only along the first and second end portions 150, 151 of the rack component 100, but not along the struts 152.

Figure 4:
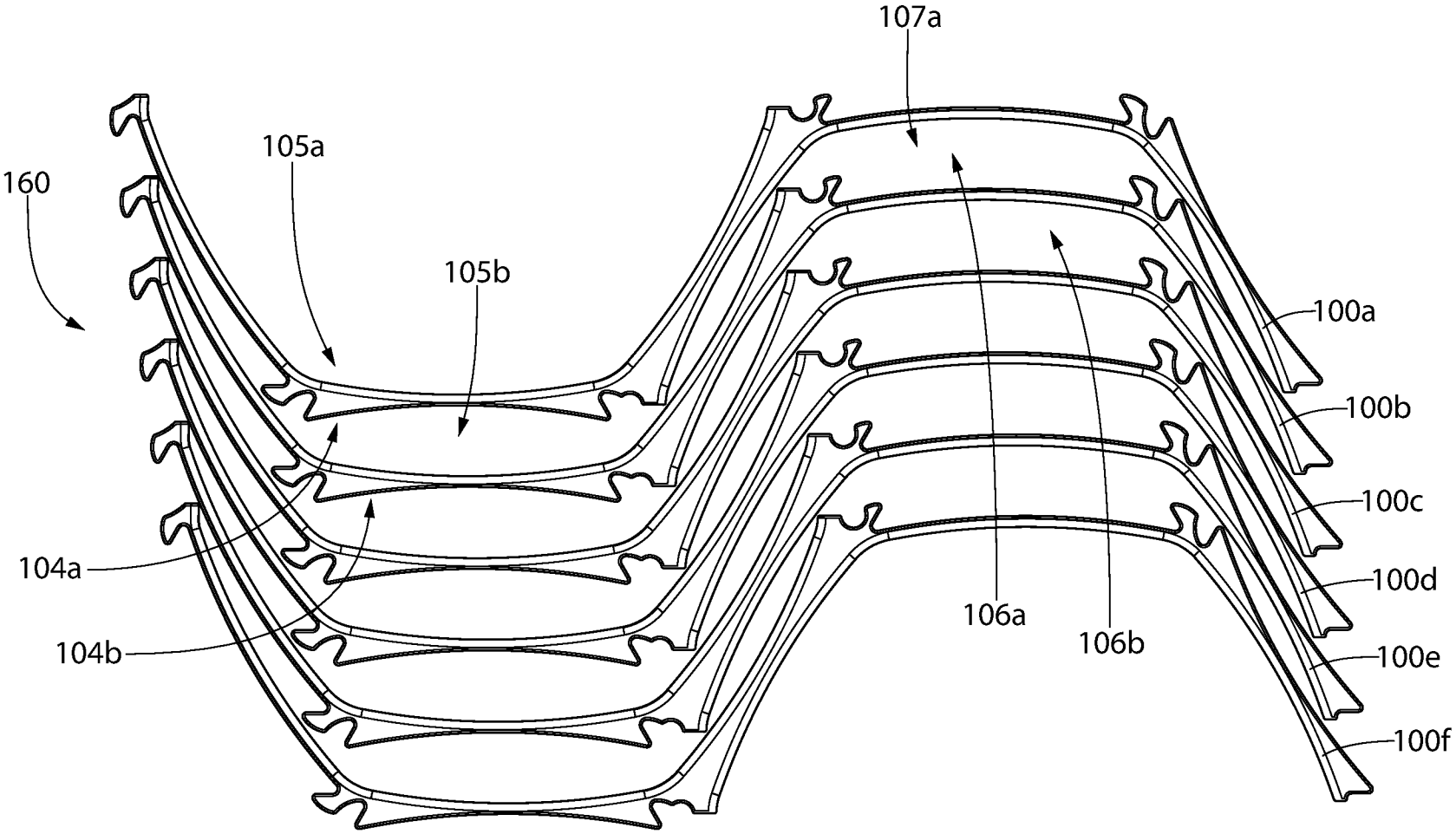
FIG. 4 is a front view of a plurality of the rack components of FIG. 1 arranged in a stack.

Referring to FIG. 4, a plurality of the rack components 100 are illustrated in a stacked arrangement. That is, a plurality of the rack components 100 may be placed together in a stack 160. Stacking the rack components 100 may make them easier to package and/or ship to consumers. FIG. 4 illustrates six of the rack components 100*a*-100*f* arranged in the stack 160. As can be seen, the rack components 100 may be stacked so that the first portion 104*a* of an upper rack component 100*a* nests within the first receptacle 105*b* of a lower rack component 100*b* and simultaneously the second portion 106*b* of the lower rack component 100*b* nests within the second receptacle 107*a* of the upper rack component 100*a*. Alternatively, while not depicted, the rack components 100 may be stacked so that the first portion 104*a* of the upper rack component 100*a* nests within the second receptacle 107*b* of the lower rack component 100*b* and the first portion 104*b* of the lower rack component 100*b* nests within the second receptacle 107*a* of the upper rack component 100*a*. This alternative stacking arrangement may be achieved by rotating about a vertical axis and flipping about a horizontal axis each rack component relative to the rack component above it. This stacking arrangement allows for the rack components 100 to be easily packaged in a flatter state for shipping and storage when not in use (as compared to the assembled state).

Figure 5:
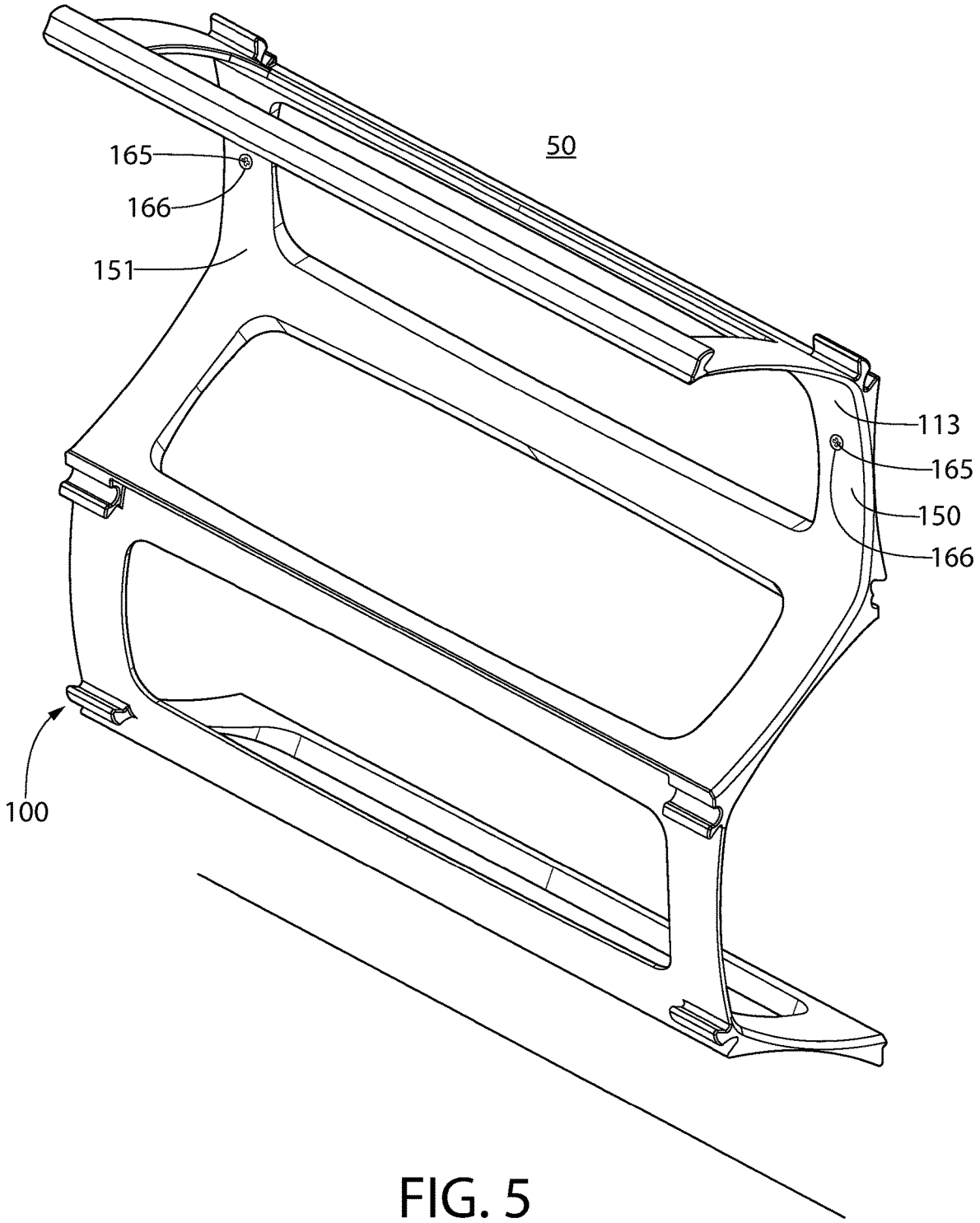
FIG. 5 is a perspective view depicting the rack component of FIG. 5 mounted directly to a wall.

FIG. 5 illustrates one of the rack components 100 mounted directly to a wall 50. The rack component 100 may comprise one or more mounting holes 165 to facilitate the direct mounting of the rack component 100 to the wall 50. The mounting holes 165 may be located along the second wall 113 with one of the holes 165 located along each of the first and second end portions 150, 151. In other embodiments, the mounting holes may be formed into the fourth wall 116 instead of, or in addition to, the second wall 113 so that the fourth wall 116 optionally abuts against the wall when mounted rather than the second wall 113 as depicted. As shown in FIG. 5, a fastener, such as a screw or other hardware, may be inserted through each of the mounting holes 165 to mount the rack component 100 to the wall 50.

Figure 6A:
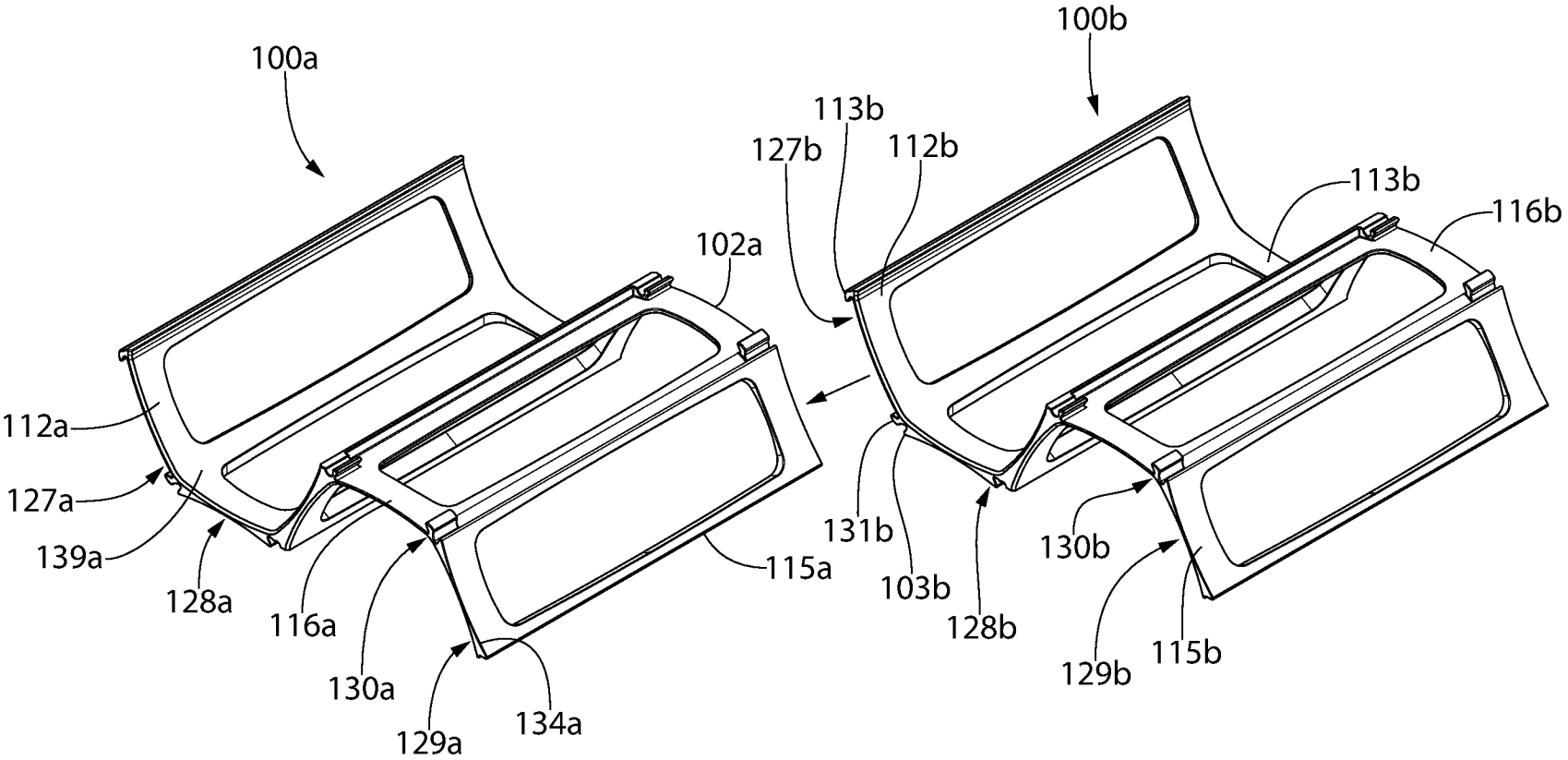
FIGS. 6A-6D illustrate the assembly of a bottle rack by slidably coupling a plurality of the rack components of FIG. 1 together.

Referring to FIGS. 6A-6D, the coupling of the rack components 100 together to form a bottle rack 180 will be described. FIG. 6A illustrates two of the rack components 100*a*, 100*b* arranged in preparation for coupling the two rack components 100*a*, 100*b* together. In particular, the third wall 115*a* of the first rack component 100*a* is aligned with the first wall 112*b* of the second rack component 100*b*. Furthermore, the first end 102*a* of the first rack component 100*a* is adjacent to the second end 103*b* of the second rack component 100*b*. As indicated by the arrow, the first and second rack components 100*a*, 100*b* are then slidably coupled together by sliding one, or both, of the first and second rack components 100*a*, 100*b* in the direction of its longitudinal axis. During such sliding movement of one or both of the first and second rack components 100*a*, 100*b*, the connection feature 129*a* of the third wall 115*a* of the first rack component 100*a* slidably engages and mates with the connection feature 127*b* of the first wall 113*b* of the second rack component 100*b*. That is, the protruding body 134*a* of the connection feature 129*a* is inserted into the recess between the two tabs 131*b* of the connection feature 127*b*. This sliding engagement locks the two rack components 100*a*, 100*b* together such that they can only be disconnected by sliding one of the rack components 100*a*, 100*b* relative to the other one of the rack components 100*a*, 100*b*.

It should be appreciated that when two of the rack components 100 are coupled together, at least one of the walls of each of the two rack components 100 overlap one another. That is, the two walls with the connection features that are engaged with one another are in an overlapping and aligned position relative to one another.

Furthermore, while engagement between the connection features 129*a*, 127*b* is shown, this is not the only way that the first and second rack components 100*a*, 100*b* may be coupled together. It may also be possible to slidably engage the connection feature 130*a* on the fourth wall 116*a* of the first rack component 100*a* with the connection feature 128*b* on the second wall 113*b* of the second rack component 100*b*. It may also be possible to slidably engage the connection feature 128*a* on the second wall 113*a* of the first rack component 100*a* with the connection feature 130*b* on the fourth wall 116*b* of the second rack component 100*b*. It may also be possible to slidably engage the connection feature

127*a* on the first wall 112*a* of the first rack component 100*a* with the connection feature 129*b* on the third wall 115*b* of the second rack component 100*b*. Basically, any one of the first type of connection features of the first rack component 100*a* may be slidably engaged with any one of the second type of connection feature of the second rack component 100*b* and any one of the second type of connection features of the first rack component 100*a* may be slidably engaged with any one of the first type of connection feature of the second rack component 100*b*. This allows for a great amount of modularity in the creation the final bottle rack product, which has a shape dictated by the way that the various rack components are coupled together.

Figure 6B:
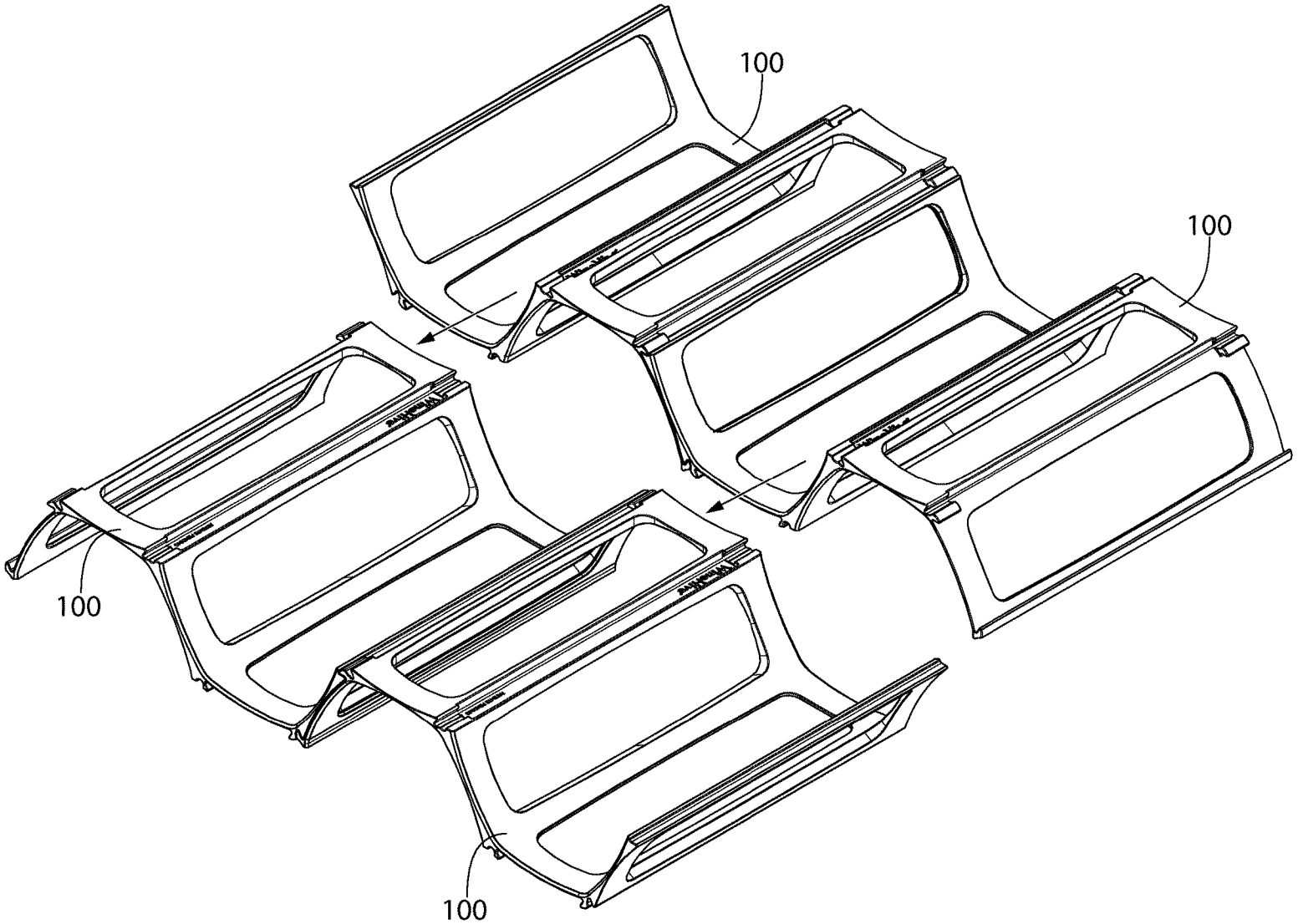

FIG. 6B continues to illustrate a bottle rack being formed by coupling more and more of the rack components 100 together in the manner described. In FIG. 6B, there are two assembled sets containing two rack components 100 each. The two assembled sets are slidably coupled together by engaging various of the connection features of the rack components 100 together.

Figure 6C:
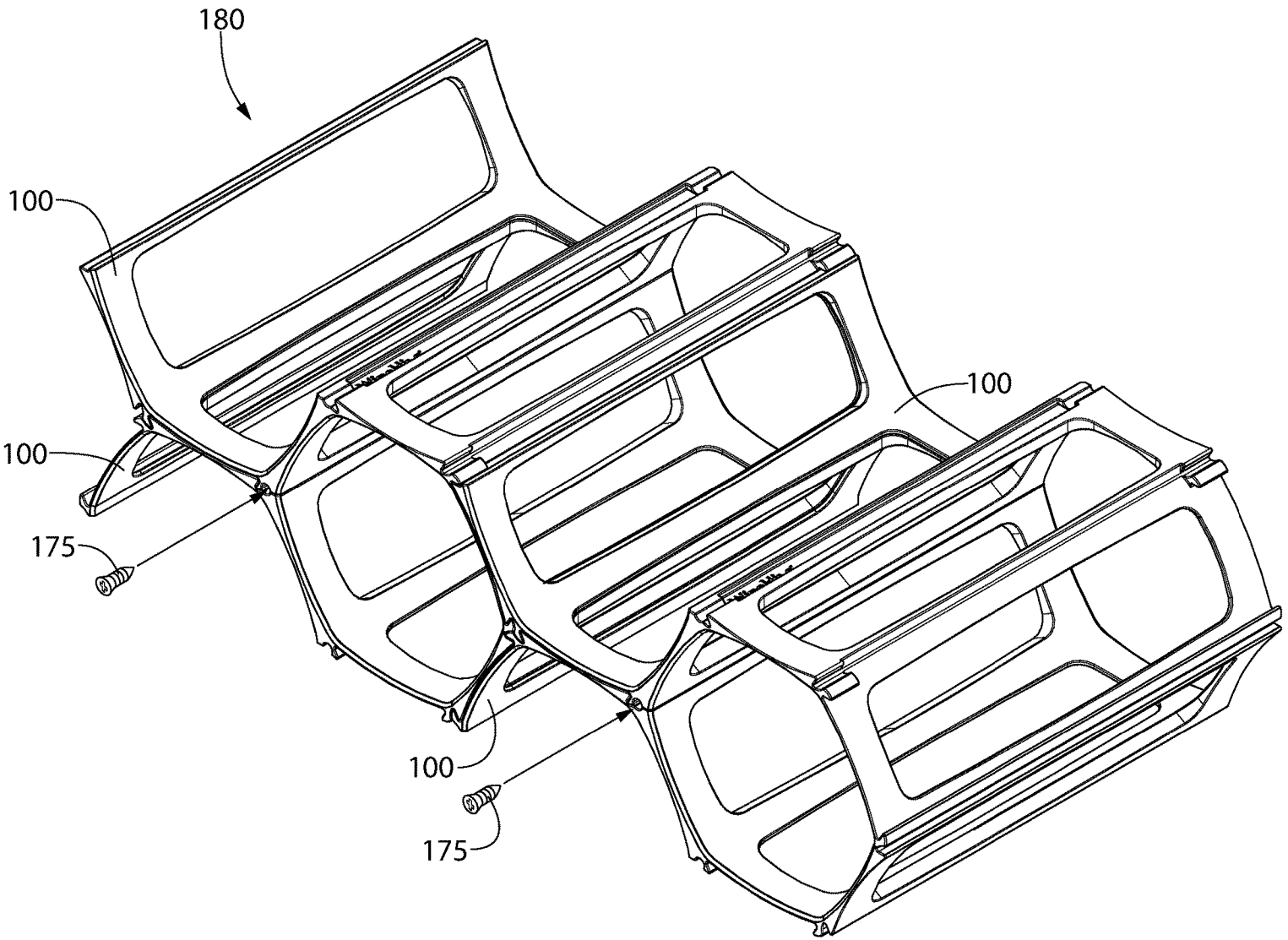
Figure 6D:
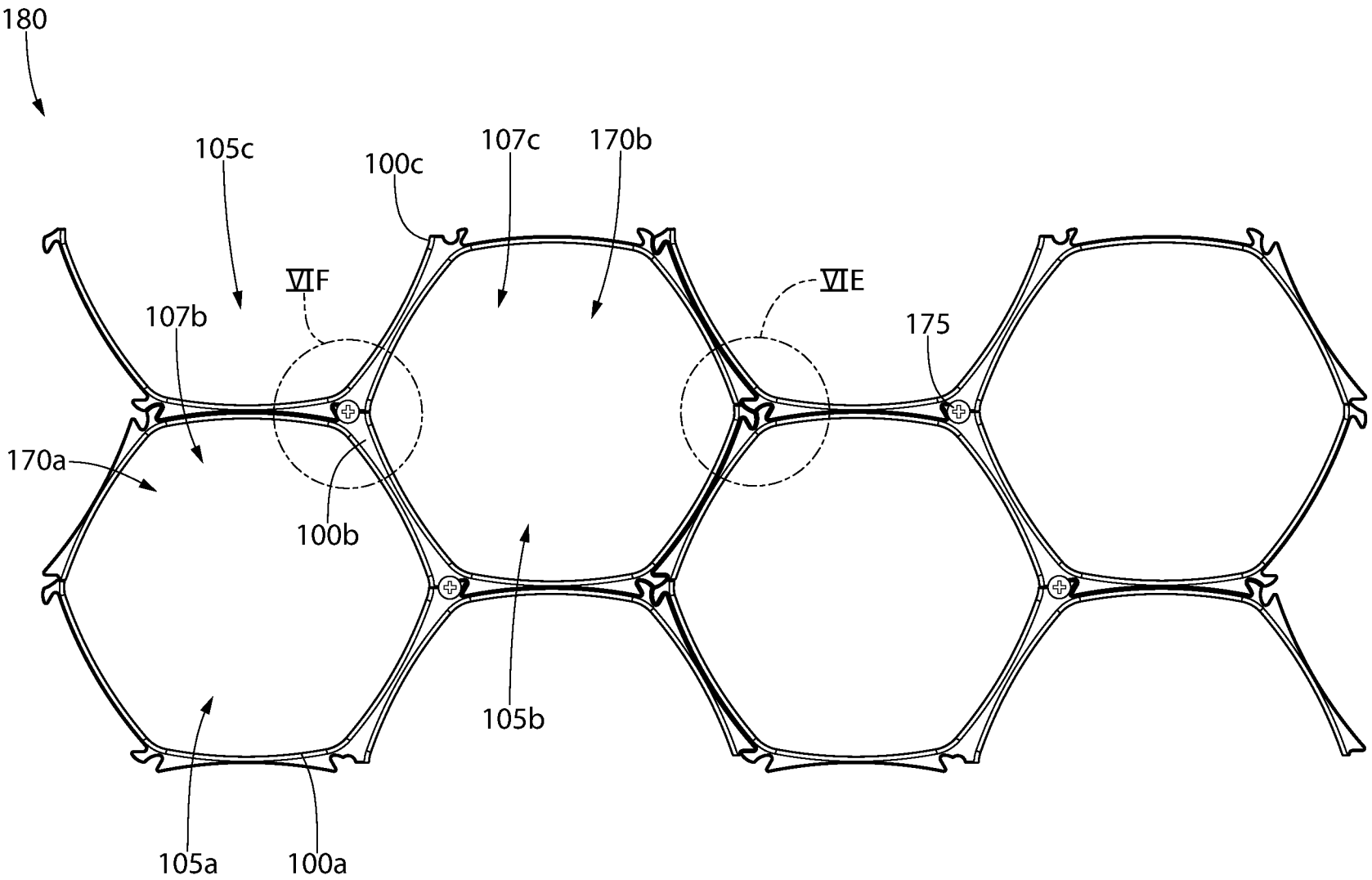

Referring to FIGS. 6C and 6D, the bottle rack 180 which is formed by slidably coupling several, in this case four, of the rack components 100 together is illustrated. FIG. 6C illustrates screws 175 being attached to the bottle rack 180 through openings formed at the interfaces of the rack components 100 to secure the attachment between the rack components 100. When the rack components 100 are coupled together, the various receptacles of the rack components 100 combine to form cavities which surround a bottle. That is, whereas the receptacles described above associated with the rack components 100 may be U-shaped, when the rack components 100 are coupled together the cavities form closed shapes (such as a circular shape or a polygonal shape like a hexagon, as shown in FIG. 6D).

In particular and with reference to FIG. 6D, the first receptacle 105*a* of the first one of the rack components 100*a* and the second receptacle 107*b* of the second one of the rack components 100*b* may collectively form a first cavity 170*a*. Similarly, the first receptacle 105*b* of the second one of the rack components 100*b* and the second receptacle 107*c* of a third one of the rack components 100*c* may collectively form a second cavity 170*b*. Thus, a bottle, such as a wine bottle or a liquor bottle or any other type of bottle, may be stored within the first cavity 170*a* or the second cavity 170*b*. Moreover, a bottle could also be stored in the upward facing receptacles, such as the first receptacle 105*c* of the third one of the rack components 100*c*. Despite the fact that a bottle would not be fully enclosed in the first receptacle 105*c*, the first receptacle 105*c* may still be sufficient to support a bottle therein.

Figure 6E:
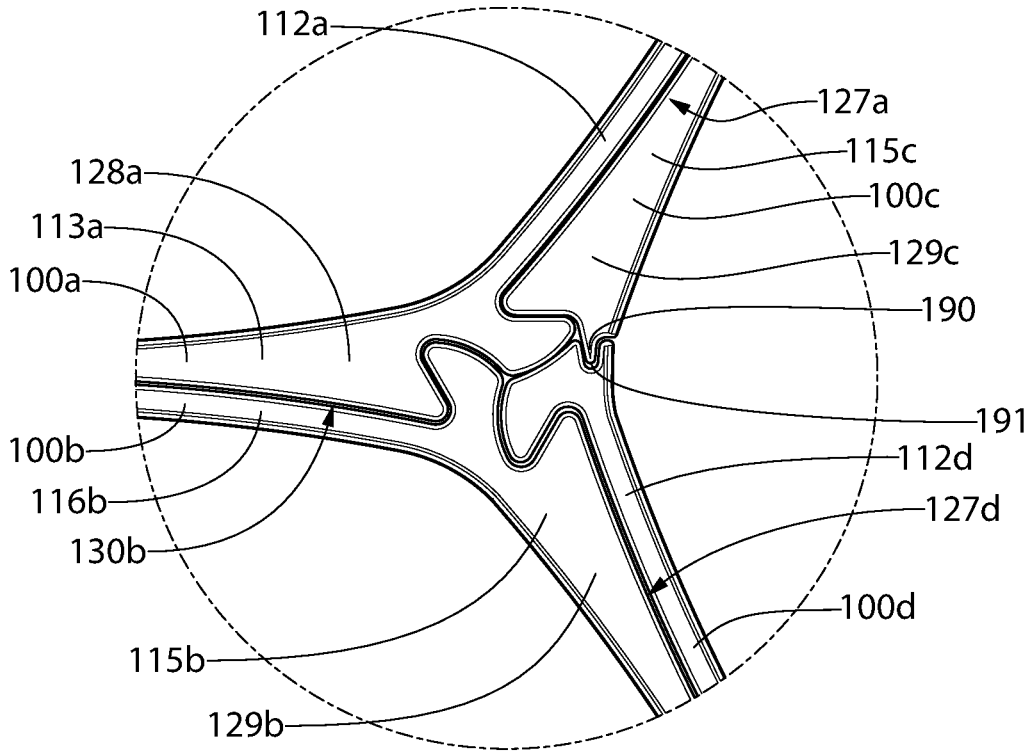
FIG. 6E is a close-up view of area VIE of FIG. 6D in accordance with an embodiment of the present invention.

FIG. 6E is a close-up view illustrating the connecting features of the different rack components 100*a-d* in accordance with an embodiment of the present invention. The male connection feature 128*a* on the second wall 113*a* of the first rack component 100*a* nests within the female connection feature 130*b* of the fourth wall 116*b* of the second rack component 100*b*. The male connection feature 129*c* of the third wall 115*c* of the third rack component 100*c* nests within the female connection feature 127*a* of the first wall 112 of the first rack component 100*a*. The male connection feature 129*b* of the second rack component 100*b* nests within the female connection feature 127*d* of the first wall 112*d* of the fourth rack component 100*d*.

Moreover, in this embodiment there is an additional tongue and groove connection to prevent the parts from flexing outward under pressure. For example, the third rack component 100*c* comprises a tongue 190 protruding outward from an outer edge of the third wall 115*c* and the fourth rack component 100*d* comprises a groove 191 formed into an outer edge of the first wall 112*d*. The tongue 190 of the third rack component 100*c* nests within the groove 191 of the fourth rack component 100*d* to strengthen the attachment between the various rack components. Thus, in some embodiments, each of the rack components 100 may comprise a tongue protruding from the outer edge of the third wall 115 and a groove formed into the outer edge of the first wall 112. These tongue and grooves are not depicted in FIGS. 1-3 and may be omitted or included in various different embodiments.

Figure 6F:
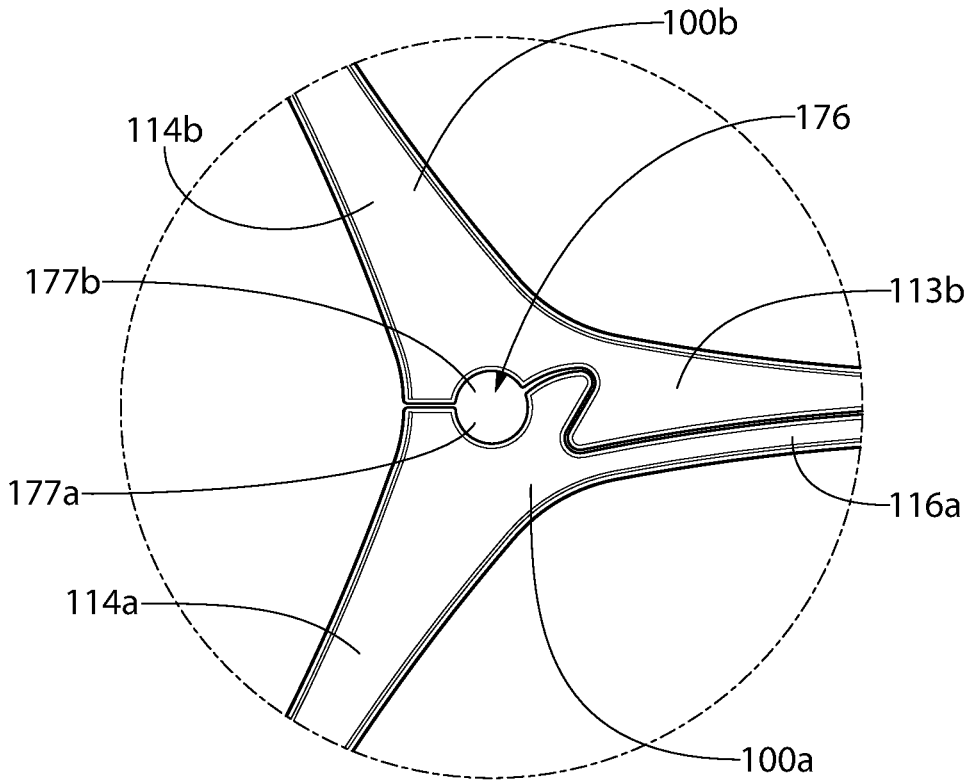
FIG. 6F is a close-up view of area VIF of FIG. 6D in accordance with an embodiment of the present invention.

FIG. 6F is a close-up view of another area of the bottle rack 180 of FIG. 6D, intended to better illustrate the location of the screw holes or bosses 176 which receive the screws 175. The screw bosses 176 may be formed by grooves 177*a*, 177*b* that are formed into the opposing ends or edges of the common wall 114. Specifically, the groove 177*a* is formed into the end of the common wall 114 that is adjacent to the fourth wall 116 and the groove 177*b* is formed into the end of the common wall 114 that is adjacent to the second wall 113. When two of the rack components 100*a*, 100*b* are coupled together, the groove 177*a* of one of the rack components 100*a* interfaces with the groove 177*b* of the other one of the rack components 100*b* to form the screw boss 176. The screw 175 can then be inserted into the screw boss 176 to securely attach the rack components 100*a*, 100*b* together.

Figure 7:
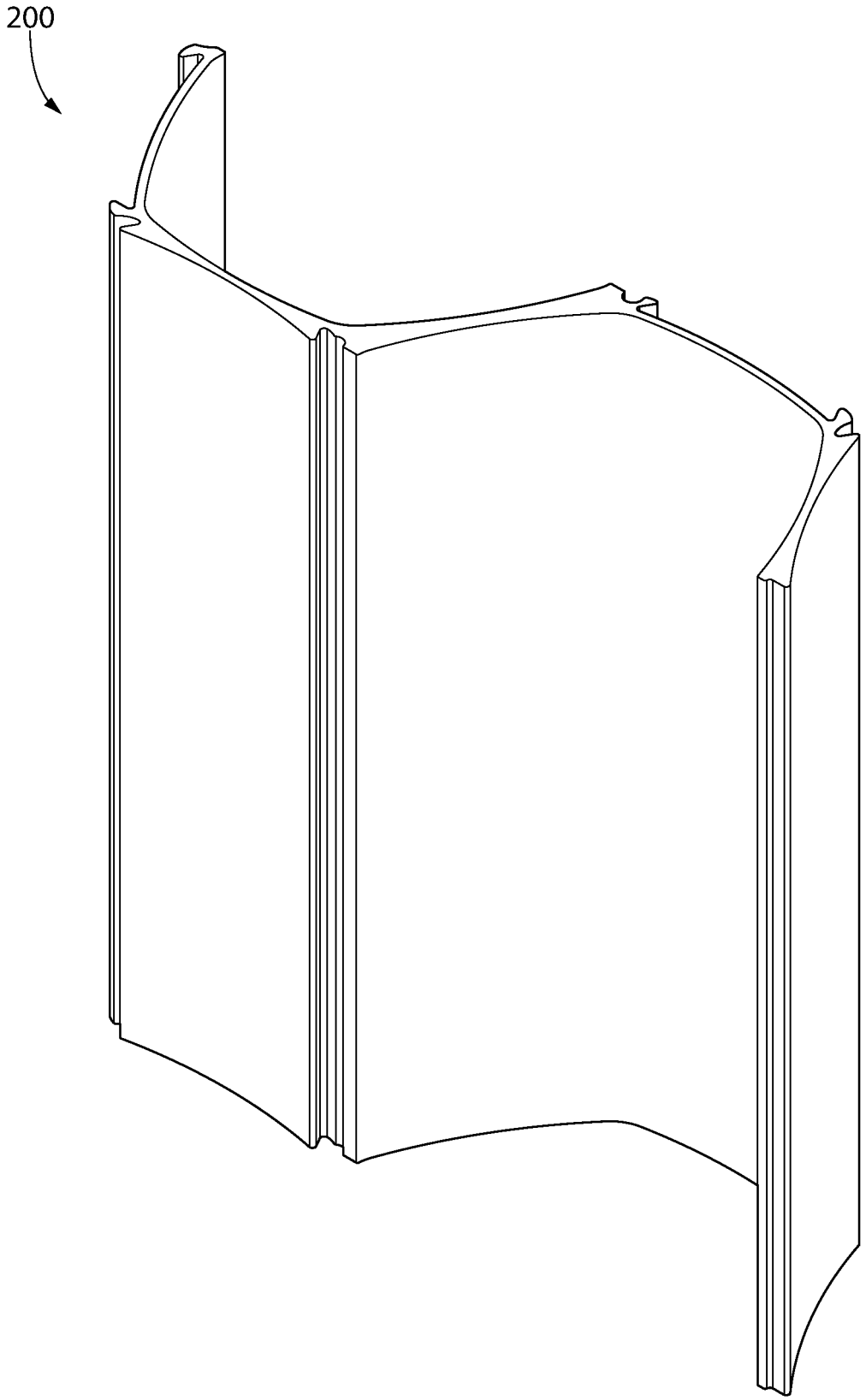
FIG. 7 is a front perspective view of a rack component of a bottle rack system in accordance with another embodiment of the present invention.

Referring to FIG. 7, a rack component 200 is illustrated in accordance with another embodiment of the present invention. The rack component 200 is identical to the rack component 100, except that the windows have been omitted and instead the rack component 200 is a fully solid structure with no openings, apertures, or windows therein. Thus, the description of the rack component 100 provided above is applicable to the rack component 200, with the exception of the discussion of the windows 141. All other features related to the shape, material, connection features, and the manner of coupling the rack components 200 together to form a bottle rack are the same as that which has been described above.

Figure 8:
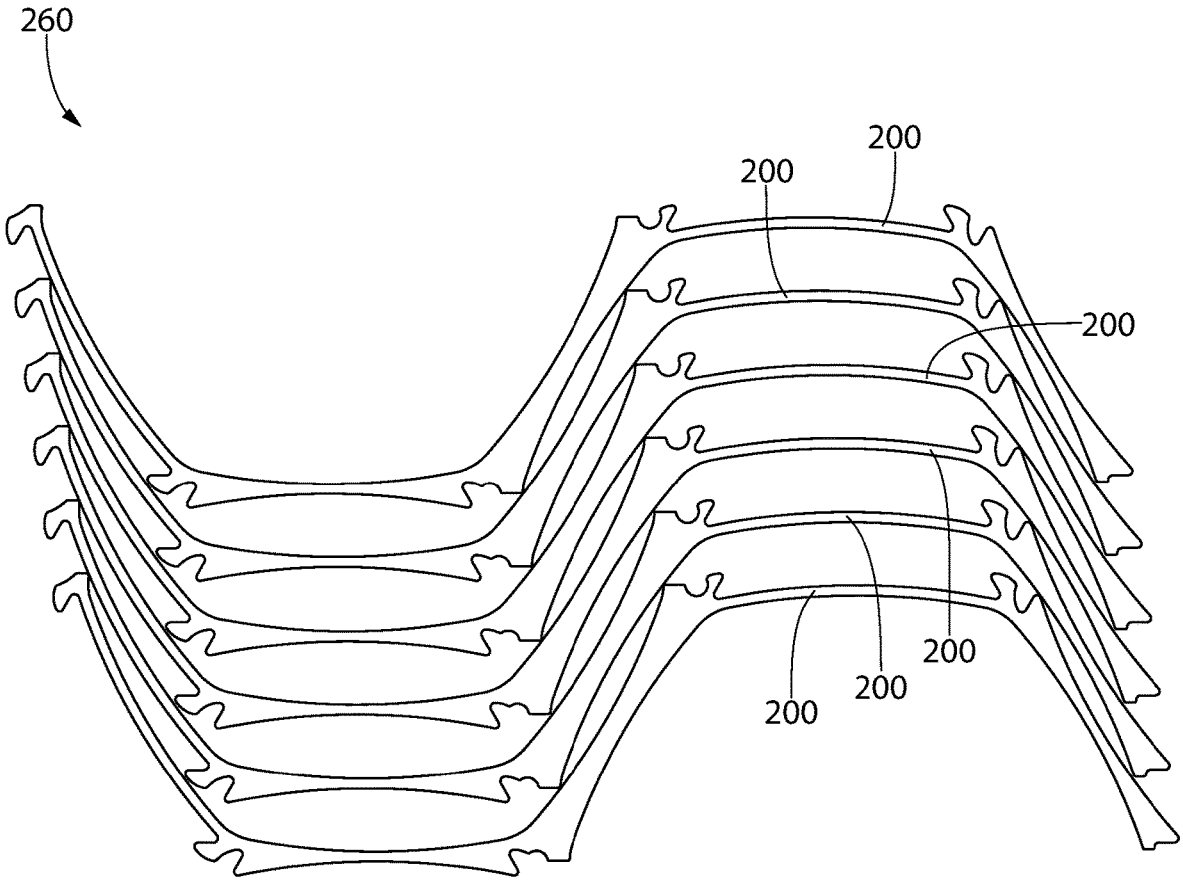
FIG. 8 is a front view of a plurality of the rack components of FIG. 7 arranged in a stack.

FIG. 8 illustrates a plurality of the rack components 200 arranged in a stack 260. The rack components 200 are stacked together in the same manner that the rack components 100 are stacked together, as was discussed above with reference to FIG. 4.

Figure 9:
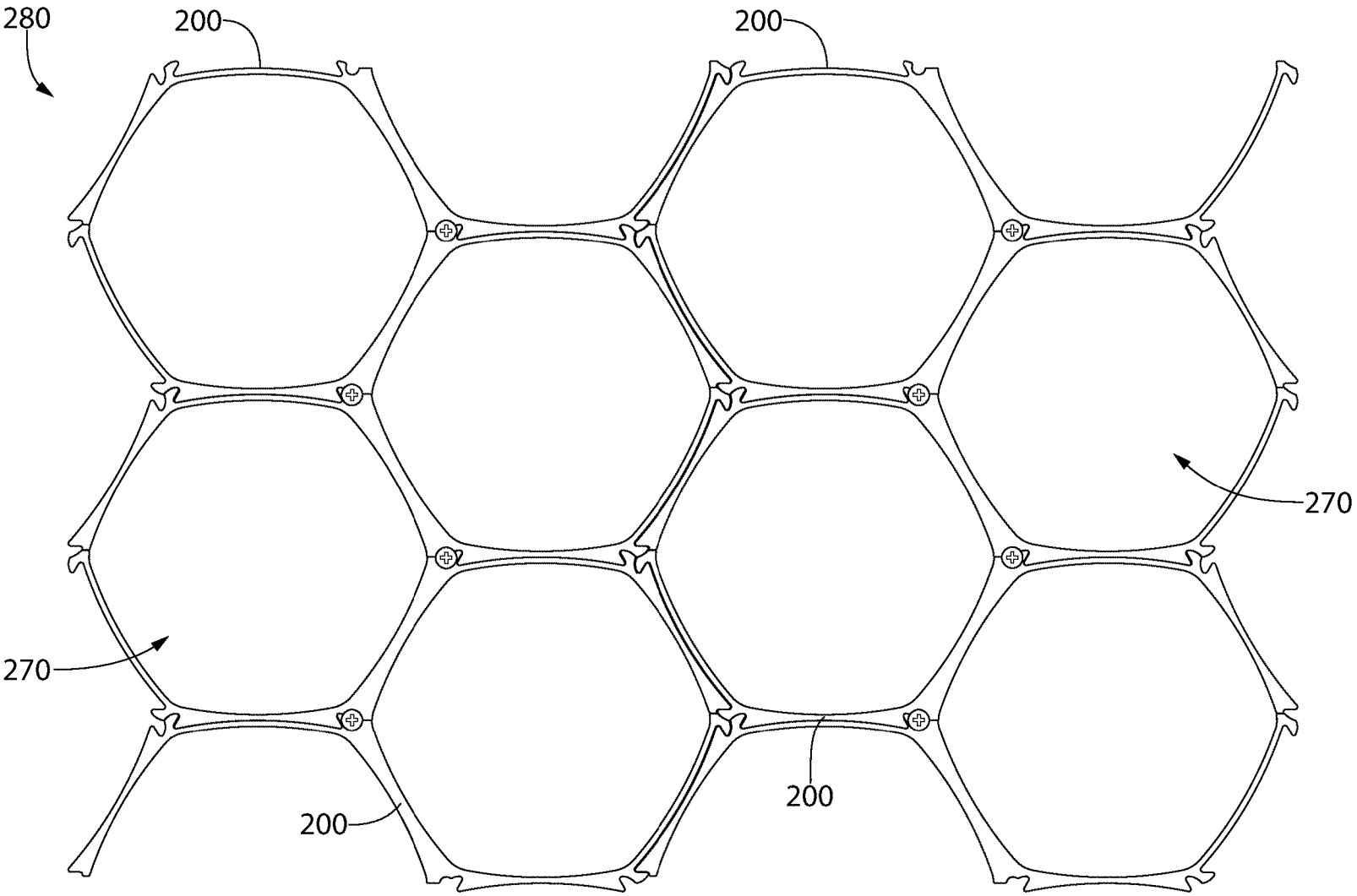
FIG. 9 is a front view of a plurality of the rack components of FIG. 7 coupled together to form a bottle rack.

FIG. 9 illustrates a plurality of the rack components 200 coupled together to form a bottle rack 280. The rack components 200 may be slidably coupled together in the exact same manner as described above with reference to the rack components 100. When the rack components 200 are coupled together, the various receptacles of the rack components 200 may combine to form cavities 270 as described above. The cavities 270 may fully surround any bottle stored therein.

Figure 10:
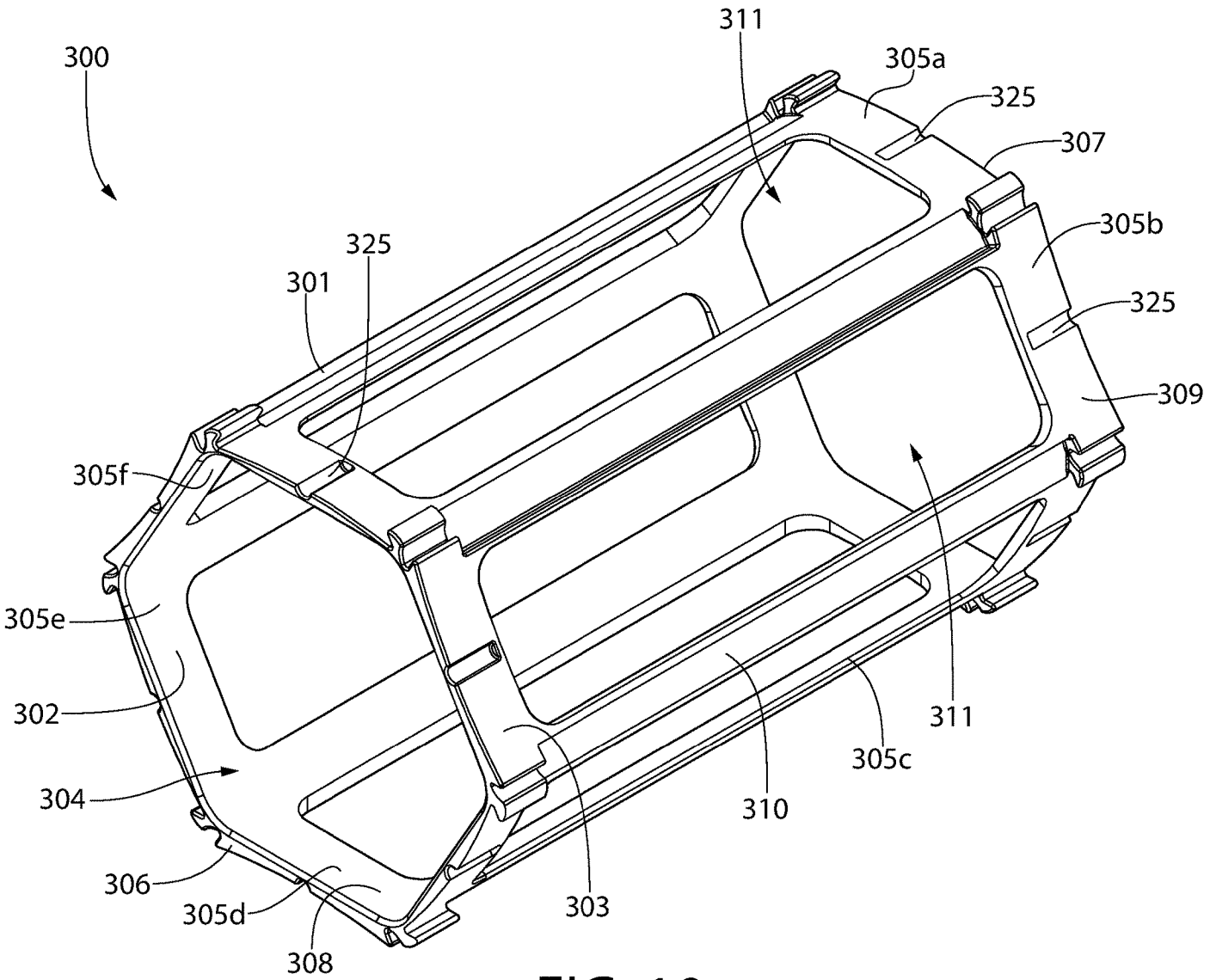
FIG. 10 is a perspective view of a rack component of a bottle rack system in accordance with yet another embodiment of the present invention.
Figure 11:
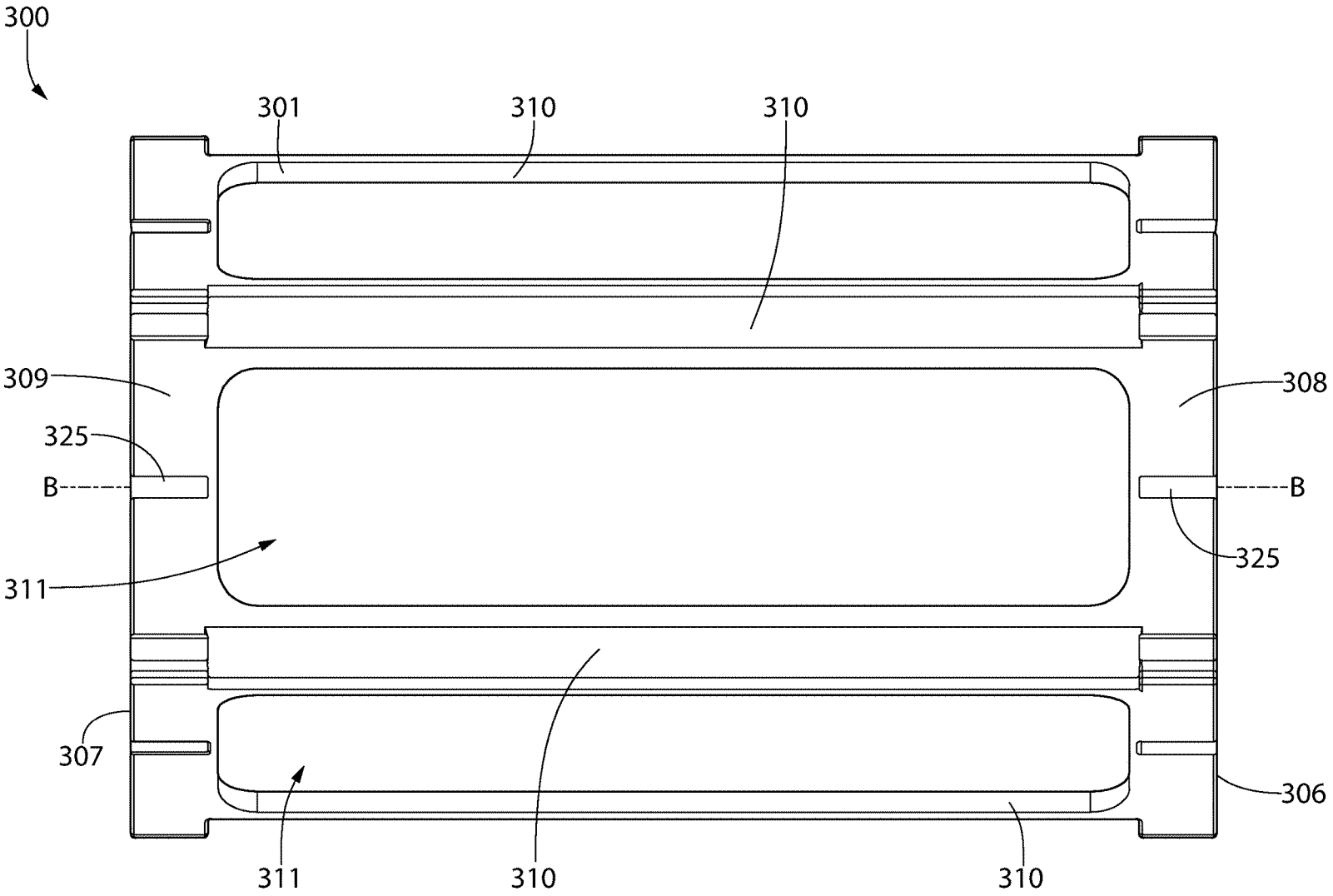
FIG. 11 is a top plan view of the rack component of FIG. 10.
Figure 12:
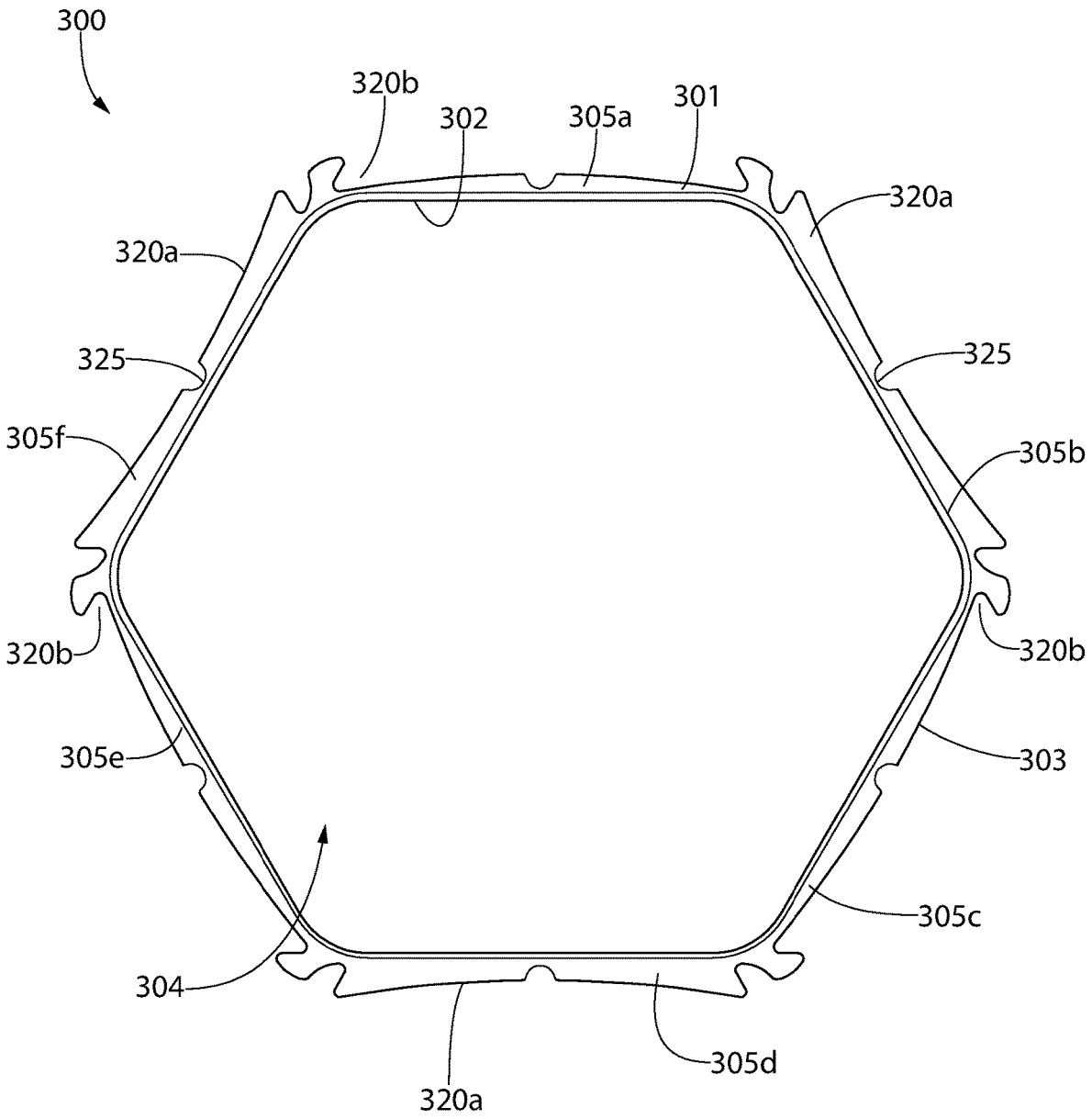
FIG. 12 is a front view of the rack component of FIG. 10.

Referring to FIGS. 10-12, a rack component 300 is illustrated in accordance with another embodiment of the present invention. As with the prior described embodiments, a plurality of the rack components 300 may be coupled together in order to create a bottle rack. The rack components 300 may be coupled together in different configurations such that the rack components 300 may form part of a modular bottle rack system. Thus, an end user can decide how exactly to build and assemble the bottle rack using a desired number of the rack components 300. The different is that in this embodiment the rack component 300 defines a full cavity rather than a partial cavity or receptacle. That is, each rack component 300 is designed to surround a bottle positioned therein.

The rack components 300 may comprise a hexagonal body 301. The hexagonal body 301 may be an integral, unitary, monolithic structure formed from metal (aluminum or any of the other metals described above), plastic, or the like. The hexagonal body 301 may comprise an inner surface 302 and an outer surface 303 opposite the inner surface 302. The inner surface 302 may define a cavity 304 that is configured to hold at least one bottle. That is, the cavity 304 may be sized and configured to receive and hold a bottle, such as a wine bottle or the like. The size of the cavity 304 may be modified depending on the type of bottle that the rack component 300 is designed to hold (one liter bottle, two liter bottle, etc.). The cavity 304 may also be sized and configured to hold more than one bottle, or to hold items other than bottles (towels, etc.). The cavity 304 may fully surround any bottle or item positioned therein, albeit with windows as described below.

In the exemplified embodiment, the hexagonal body 301 comprises six sidewalls 305*a-f* that are arranged in the shape of a hexagon. While the hexagonal shape is used in the exemplified embodiment, other shapes may be used, including circular, polygonal, square, or the like. The hexagonal body 301 extends from a first end 306 to a second end 307 along a longitudinal axis B-B. The hexagonal body 301 comprises a first annular end portion 308 that comprises the first end 306 and a second annular end portion 309 that comprises the second end 307. Furthermore, the hexagonal body 301 comprises a plurality of struts 310 that extend from the first annular end portion 308 to the second annular end portion 309 in a circumferentially spaced apart manner. In the exemplified embodiment, there are six of the struts 310. The first and second annular end portions 308, 309 comprise a plurality of sides and a plurality of vertices. In the exemplified embodiment, each of the struts 310 intersects one of the vertices of each of the first and second annual end portions 308, 309.

The hexagonal body 301 comprises a plurality of connection features 320*a*, 320*b* that facilitate the coupling of the plurality of rack components 300 together. Specifically, the first and second annular end portions 308, 309 comprise the plurality of connection features 320*a*, 320*b*. Each adjacent side of the first and second annular end portions 308, 309 may alternate between comprising one of the connection features 320*a* and one of the connection features 320*b* so that no two adjacent sides of the first and second annular end portions 308, 309 has the same type of connection feature 320*a*, 320*b*. The connection features 320*a* may be a female connection feature and the connection features 320*b* may be a male connection feature. The female connection feature 320*a* of one rack component 300 may be configured to be slidably engaged with the male connection feature 320*b* of another one of the rack components during the coupling of the rack components 300 together. The connection features 322*a*, 320*b* may slidably mate to form a dovetail joint, such that the male connection feature is a pin and the female connection feature is a socket of the dovetail joint. The connection features 320*a*, 320*b* may be formed on the outer surface 303 of the hexagonal body 301 along the first and second annular end portions 308, 309 of the hexagonal body 301.

The hexagonal body 301 may comprise a groove 325 located centrally along each of the sides of each of the first and second annular end portions 308, 309. The grooves 325 on the first annular end portion 308 extend inwardly from the first end 306 and the grooves 325 on the second annular end portion 309 extend inwardly from the second end 307. The grooves 325 may be located along the first and second annular end portions 308, 309 at locations that are centrally positioned between two adjacent ones of the plurality of struts 310. When two of the rack components 300 are coupled together, one of the grooves 325 of each of the two rack components 300 may be aligned to form a circular opening that receives a fastener such as a screw to securely couple the two rack components 300 together.

The hexagonal body 301 comprises a plurality of windows 311. Each of the windows 311 may be defined between a portion of the first annular end portion 308, a portion of the second annular end portion 309, and two adjacent ones of the struts 310. The windows 311 may extend from the outer surface 303 of the hexagonal body 301 to the inner surface 302 of the hexagonal body 301. Each of the windows 311 may have an elongated rectangular shape. The windows 311 are configured to allow visibility to a label of a bottle held in the cavity 304. The windows 311 may extend along a majority of the length of the hexagonal body 301. The windows 311 may extend along the full length of each of the struts 310 in between the adjacent struts 310. Thus, the windows result in a significant reduction in material needed to form the hexagonal body 301, while also providing visibility to a label on the bottle contained in the cavity 304.

Figure 13A:
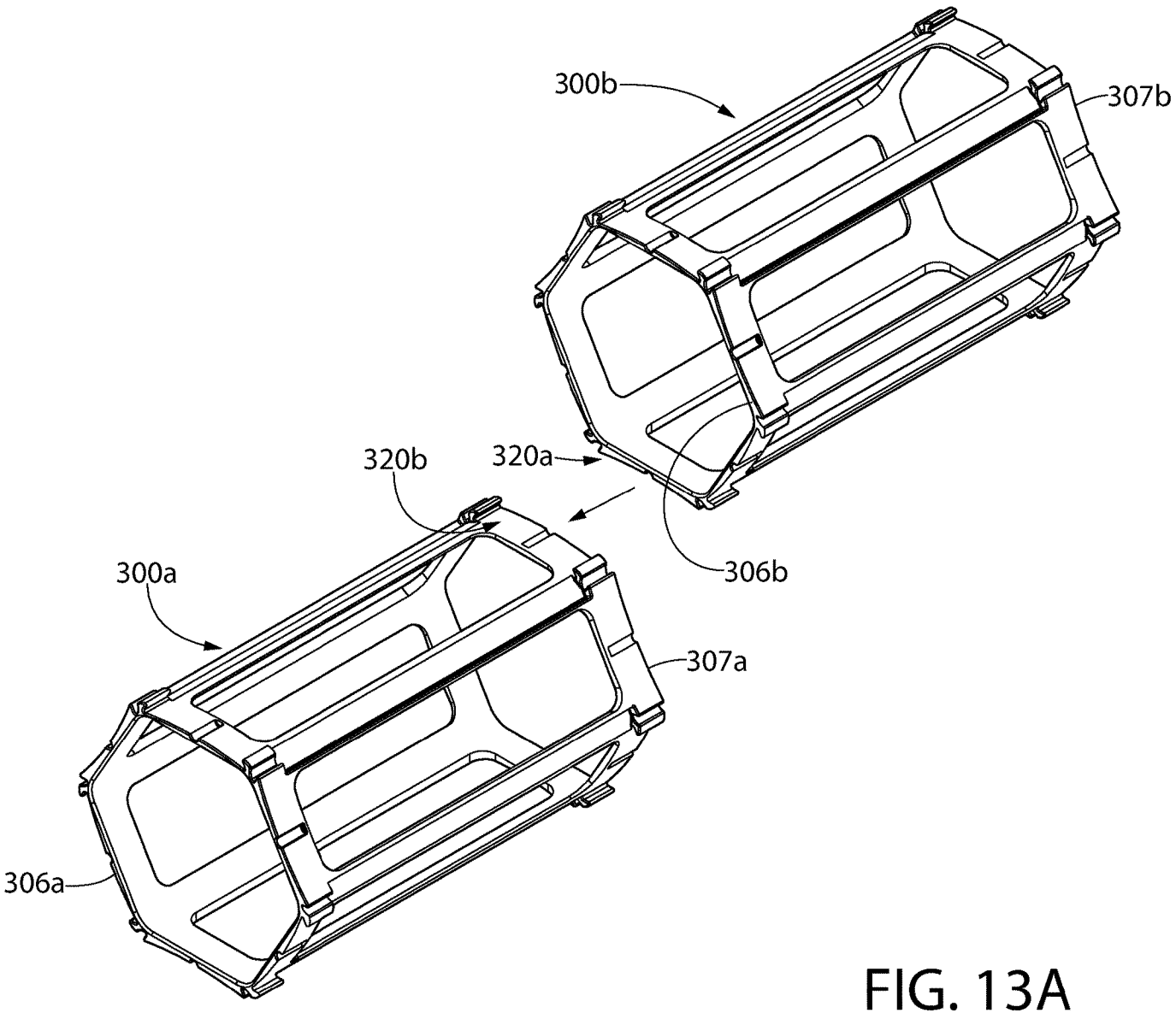
FIGS. 13A-13D illustrate the assembly of a bottle rack by slidably coupling a plurality of the rack components of FIG. 10 together.
Figure 13B:
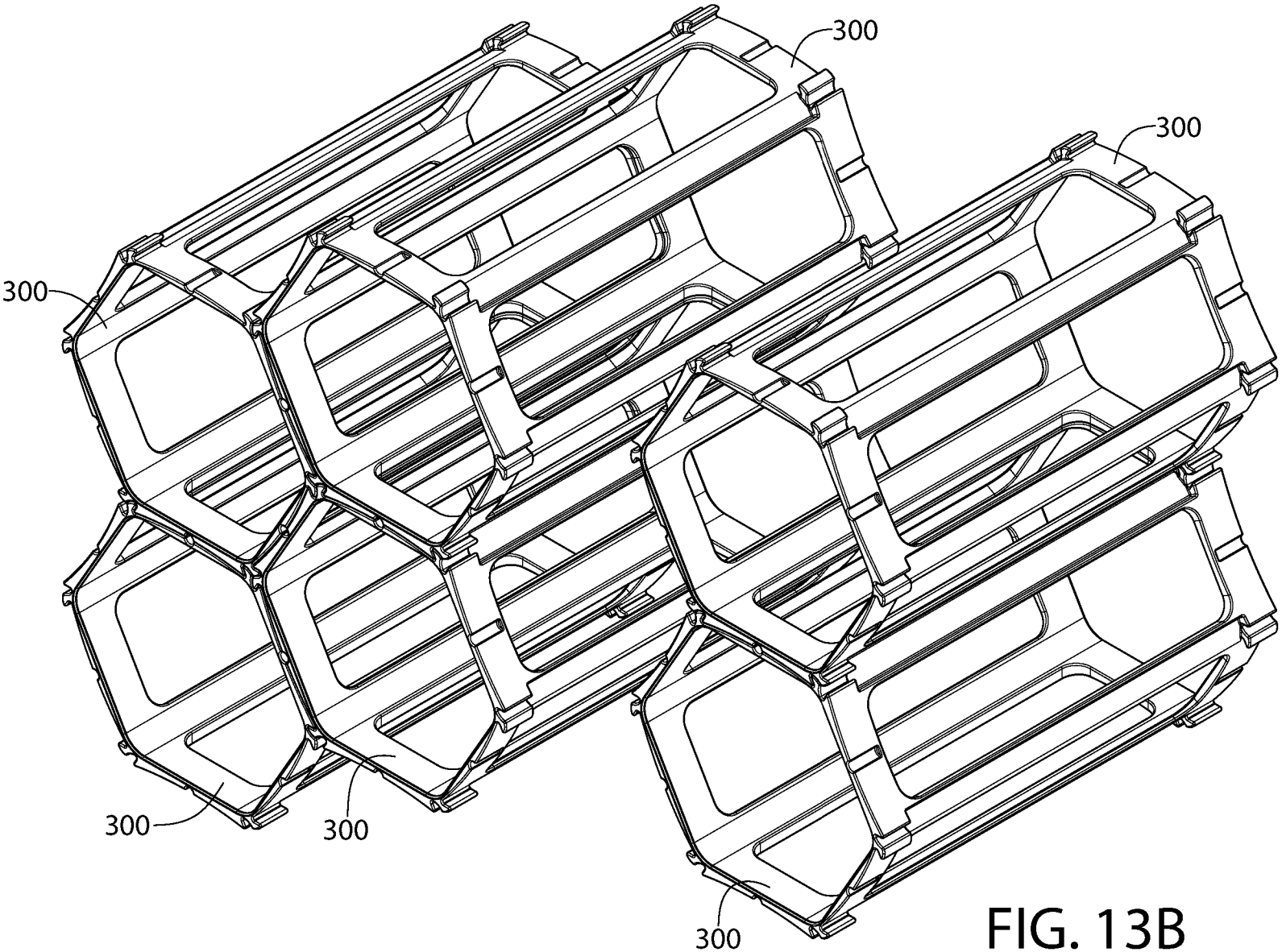
Figure 13C:
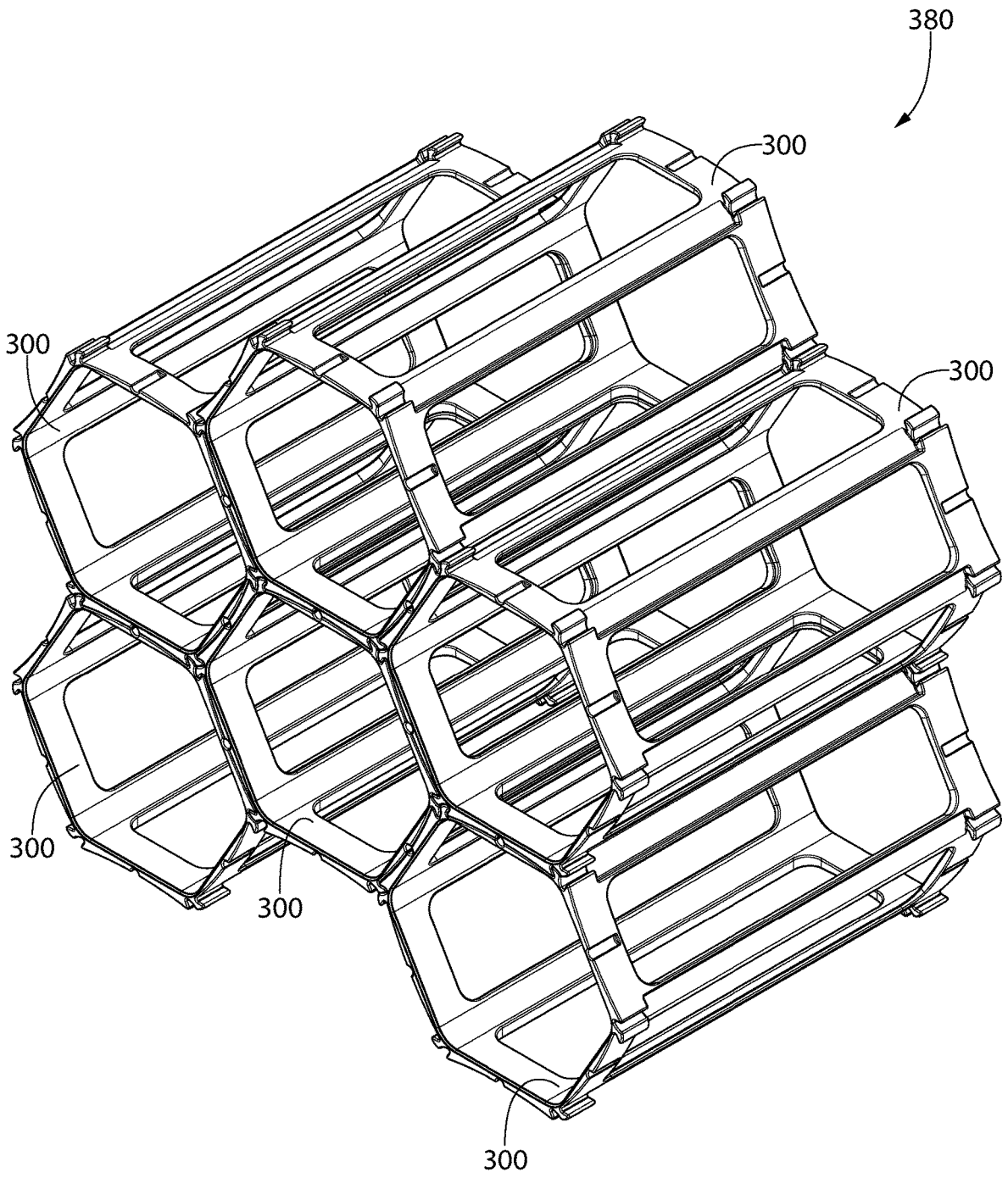

FIGS. 13A-13C illustrate the assembly of a bottle rack 380 by slidably coupling a plurality of the rack components 300 together. First, referring to FIG. 13A, a first rack component 300*a* and a second rack component 300*b* are positioned with one of the first and second ends 306*a*, 307*a* of the first rack component 300*a* adjacent to one of the first and second ends 306*b*, 307*b* of the second rack component 300*b*. This may be interchangeable such that the first ends 306*a*, 306*b* may be adjacent, the second ends 307*a*, 307*b* maybe adjacent, or the first end 306*a* of the first rack component 300*a* may be adjacent to the second end 307*b* of the second rack component 300*b*, or vice versa. Furthermore, the second rack component 300*b* is positioned slightly elevated relative to the first rack assembly 300*a*. Moreover, the first and second rack components 300*a*, 300*b* are angularly oriented so that the first type of connection feature 320*a* of one of the rack components 300*a*, 300*b* is aligned with the second type of connection feature 320*b* of the other one of the rack components 300*a*, 300*b*.

Next, the first and/or second rack components 300*a*, 300*b* are moved towards one another in the direction of the longitudinal axes B-B until the connection features 320*a*, 320*b* of the first and second rack components 300*a*, 300*b* engage and mate with one another. The first and/or second rack components 300*a*, 300*b* are continued to slide relative to one another until the ends 306, 307 of the first and second rack components 300*a*, 300*b* are in alignment. FIG. 13B illustrates a set of four of the rack components 300 coupled together and a separate set of two rack components 300 coupled together. Furthermore, FIG. 13B illustrates the two sets of rack components 300 being slidably coupled together by engaging the connection features 320 of various ones of the rack components 300 together. FIG. 13C illustrates the six rack components 300 having been coupled together to form the bottle rack 380. As should be appreciated more or less than six of the rack components 300 may be used to form the bottle rack 380 in different embodiments. The number of the rack components 300 and the particular configuration at which they are attached may be changed to meet the user's functional or aesthetic needs or desires.

Figure 13D:
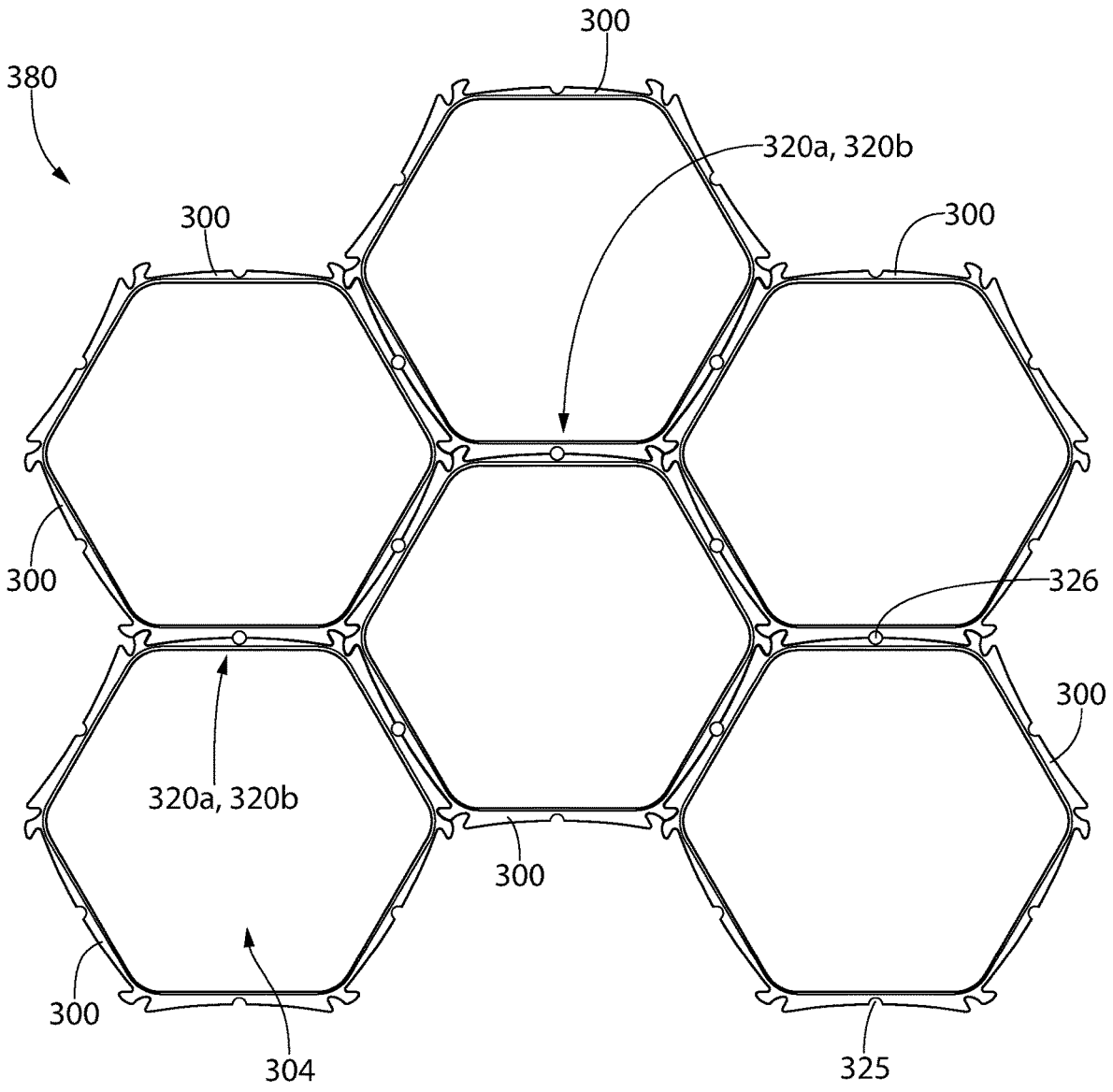

FIG. 13D is a front view of the bottle rack 380 which is formed by slidably coupling six of the rack components 300 together in the manner previously described. The various connection features 320*a*, 320*b* are slidingly engaged and mated with each other to connect the rack components 300 together. The rack components 300 may only be decoupled from one another by further sliding the rack components 300 relative to one another until the various connection features 320*a*, 320*b* become disengaged. Additional fasteners such as screws or the like may be used to secure the attachment as described herein with reference to an earlier described embodiment. For example, such fasteners may be inserted through the circular openings 326 formed by the interfacing grooves 325 of two of the rack components 300.

Figure 14:
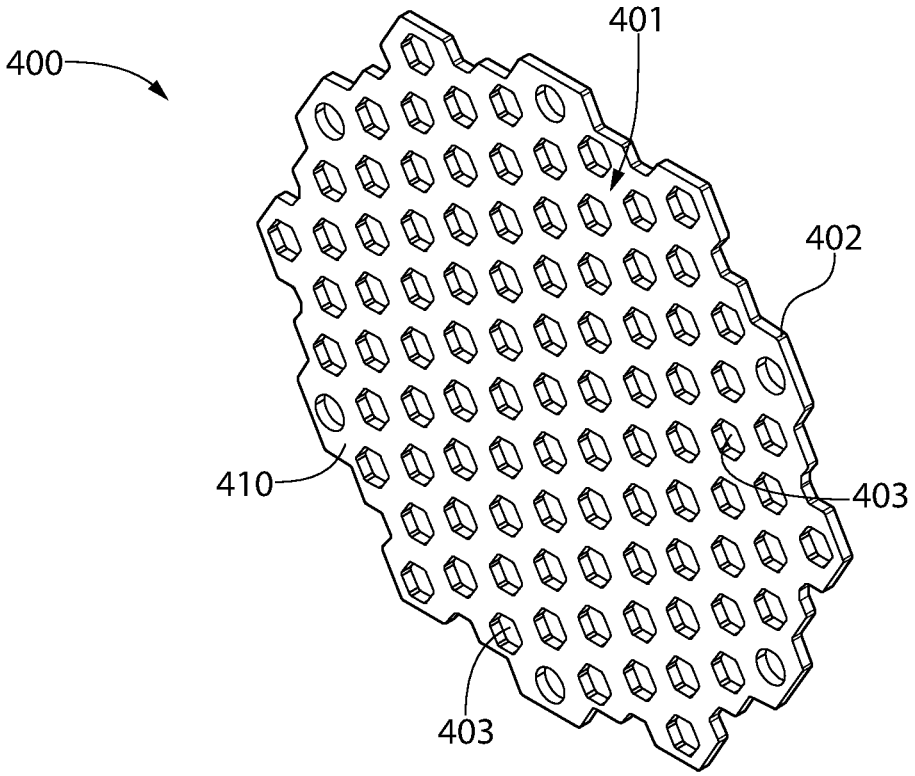
FIG. 14 is a perspective view of a mounting bracket in accordance with an embodiment of the present invention.

Referring to FIG. 14, a mounting bracket 400 is illustrated in accordance with an embodiment of the present invention. The mounting bracket 400 comprises a flat plate 410 having a front surface 401 and a rear surface 402 opposite the front surface 401. The front and rear surfaces 410 may both be flat and planar. The mounting bracket 400 may have a generally hexagonal shape in the exemplified embodiment, but may take on other shapes in other embodiments. The mounting plate 400 comprises a plurality of apertures 403 extending from the front surface 401 to the rear surface 402. In the exemplified embodiment, some of the apertures 403 are circular and some of the apertures 403 are hexagonal. However, the shape of the apertures 403 is not to be limiting of the invention in all embodiments.

Figure 14A:
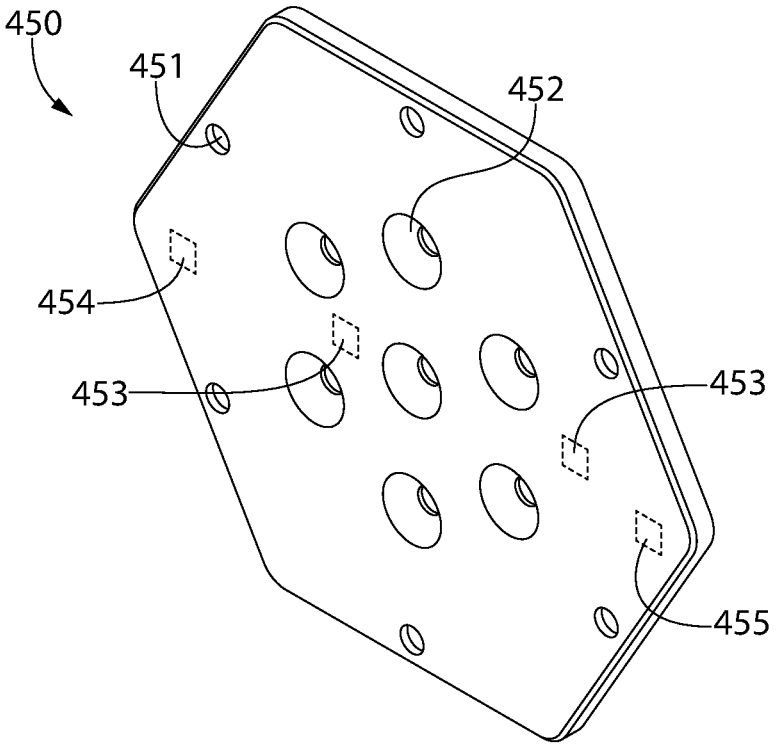
FIG. 14A is a perspective view of a mounting bracket in accordance with another embodiment of the present invention.

FIG. 14A illustrates a mounting bracket 450 in accordance with another embodiment. The mounting bracket 450 is also hexagonal in shape. The mounting bracket 450 comprises a plurality of first screw holes 451 arranged along a periphery of the mounting bracket 450 for coupling the mounting bracket 450 to one of the rack components 300. The mounting bracket 450 could also be coupled to a bottle rack formed by the rack components 100 or the rack components 200 as described herein. The mounting bracket 450 also comprises a plurality of second screw holes 452 for mounting the mounting bracket 450 to a wall. The second screw holes 452 may be countersunk. The specific number and positioning of the various screw holes 451, 452 may not be limiting of the invention in all embodiments.

Figure 15:
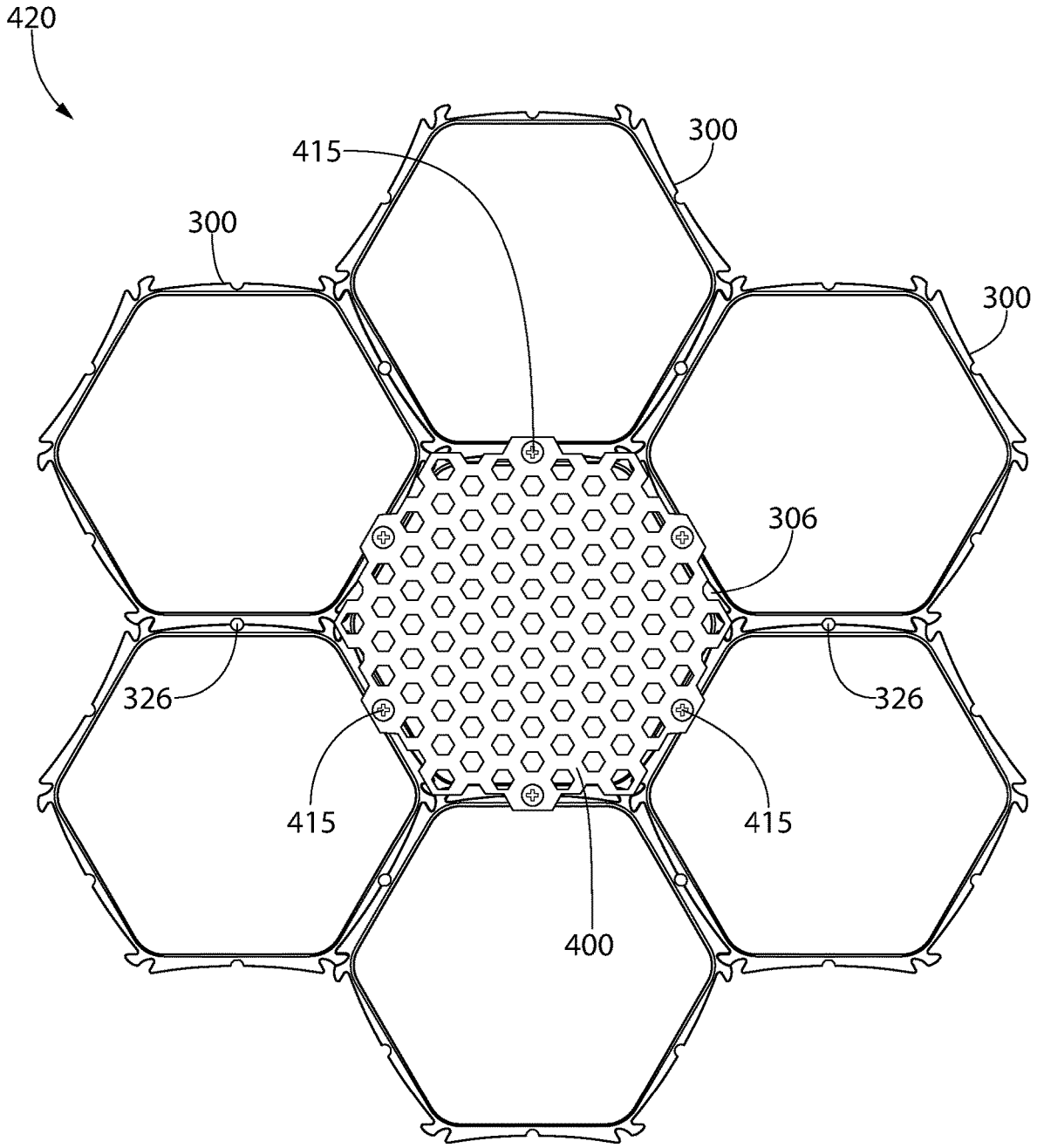
FIG. 15 is a front view of a bottle rack formed by coupling a plurality of the rack components of FIG. 10 together with one of the mounting brackets of FIG. 14 coupled thereto.

Referring to FIG. 15, the mounting bracket 400 is illustrated coupled to a bottle rack 420 that is formed by slidably coupling seven of the rack components 300 together. As stated above the mounting bracket 400 could also be coupled to a bottle rack formed by coupling a plurality of the rack components 100 or a plurality of the rack components 200 together. As noted herein, the bottle rack 420 may take on any desired configuration. Moreover, while only one of the mounting brackets 400 is depicted in FIG. 15 coupled to the bottle rack 420, more than one of the mounting brackets 400 may be coupled to the bottle rack 420 in other embodiments. The mounting bracket 400 may be used to mount the bottle rack 420 to a wall or other vertical surface. Thus, depending on the weight of the bottle rack 420 and other considerations, multiple of the mounting brackets 400 may be needed and used.

The mounting bracket 400 is coupled to the first end 306 of one of the rack components 300. The mounting bracket 400 may alternatively be coupled to the second end 307 of one of the rack components 300. The mounting bracket 400 is coupled to the first end 306 of one of the rack components 300 by aligning the mounting bracket 400 with an opening at the first end 306 of the rack component 300 so that several of the apertures 403 of the mounting bracket 400 are aligned with several of the openings 326 of the bottle rack 420. Next, a fastener 415, such as a screw or the like, may be inserted through the apertures 403 and the openings 326 to couple the mounting bracket 400 to the bottle rack 420.

Figure 16A:
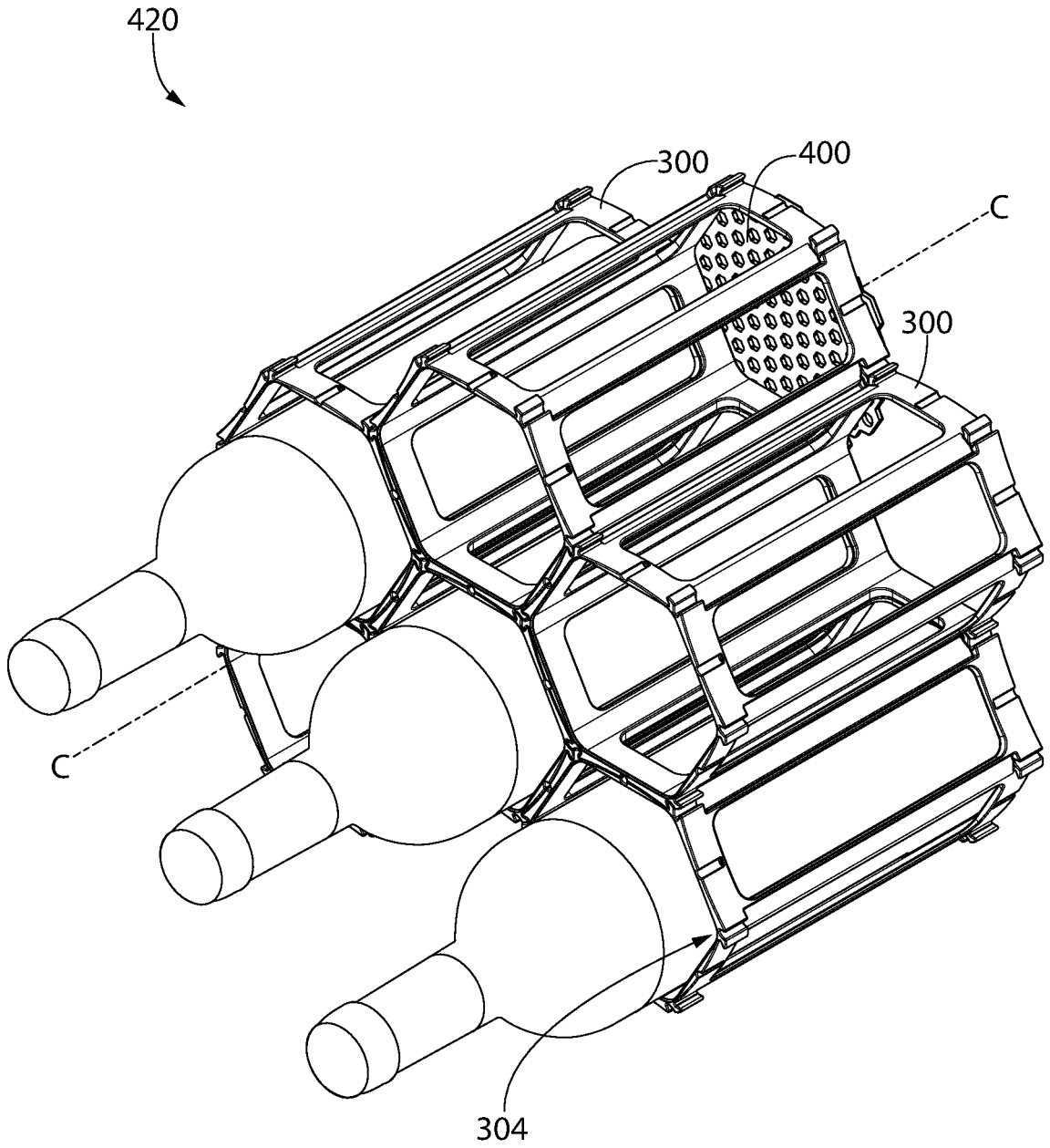
FIG. 16A is a perspective view of the bottle rack of FIG. 15 with a plurality of bottles being supported by the bottle rack.
Figure 16B:
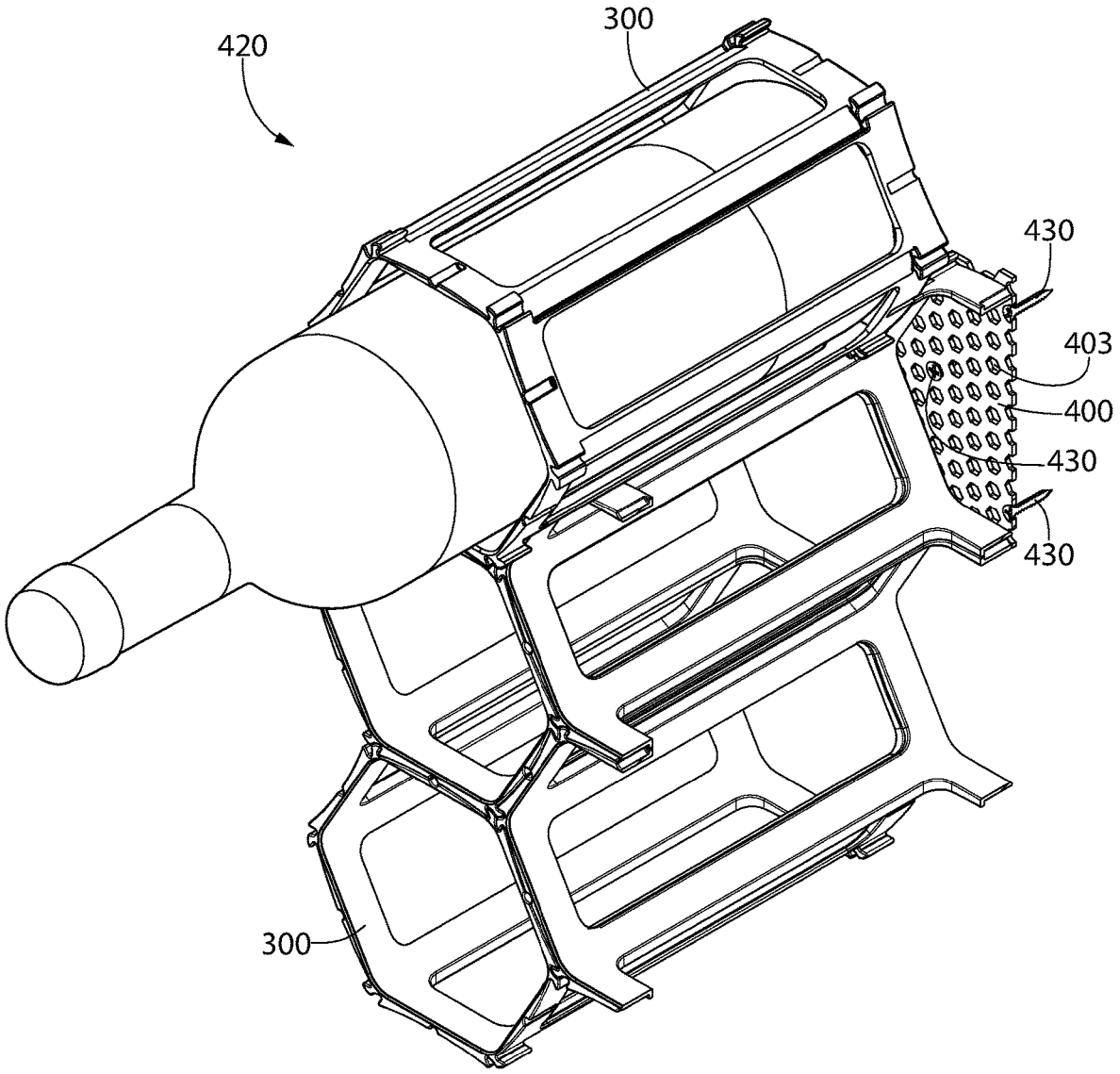
FIG. 16B is a cross-sectional view taken along line XVI-XVI of FIG. 16A to illustrate the manner of coupling the mounting bracket to a wall.

Next, referring to FIGS. 16A and 16B, the bottle rack 420 may be mounted to the wall. This may be achieved by positioning the bottle rack 420 with the mounting bracket 400 in abutment with the wall and then inserting one or more fasteners (e.g., screws) 430 through one of the additional holes of the mounting bracket 400 and into the wall. As shown in FIGS. 16A and 16B, bottles may be positioned within the cavities 304 of any or all of the rack components 300 for storage or the like. The cavities 304 of the rack components 300 extend along a cavity axis C-C. When using the mounting bracket 400 to mount the bottle rack 420 to the wall, the cavity axes C-C of the cavities 304 of the rack components 300 extend generally perpendicularly from the wall. Thus, any bottles that are held in the bottle rack 420 are oriented in a cork-forward position, meaning that the corks of the bottles are positioned facing the user and as the portion of the bottle that is furthest from the wall. The windows 341 in the rack components 300 provide visibility to the labels of the bottles so that a user can determine which bottle contains which liquid without having to remove the bottles from the bottle rack 420.

The mounting bracket 400 may be configured as an electronic device in some embodiments. In particular, the flat plate 410 may define a cavity designed to house electronic components, such as light emitting diodes (LEDs), a processor, a Bluetooth communication module, or the like. The mounting bracket 400 may be configured for operable communication with a software application residing on an electronic device such as a smart phone, a laptop, or the like. As such, the user may be able to control the operation of the LEDs of the mounting bracket such as changing the on/off schedule, light intensity, light color, or the like via their smart phone or other electronic device. FIG. 14A illustrates LEDs 45, a processor 454, and a Bluetooth communication module 455 using ghost lines to depict that they may be housed within the interior of the flat plate of the mounting bracket 450.

Figure 17:
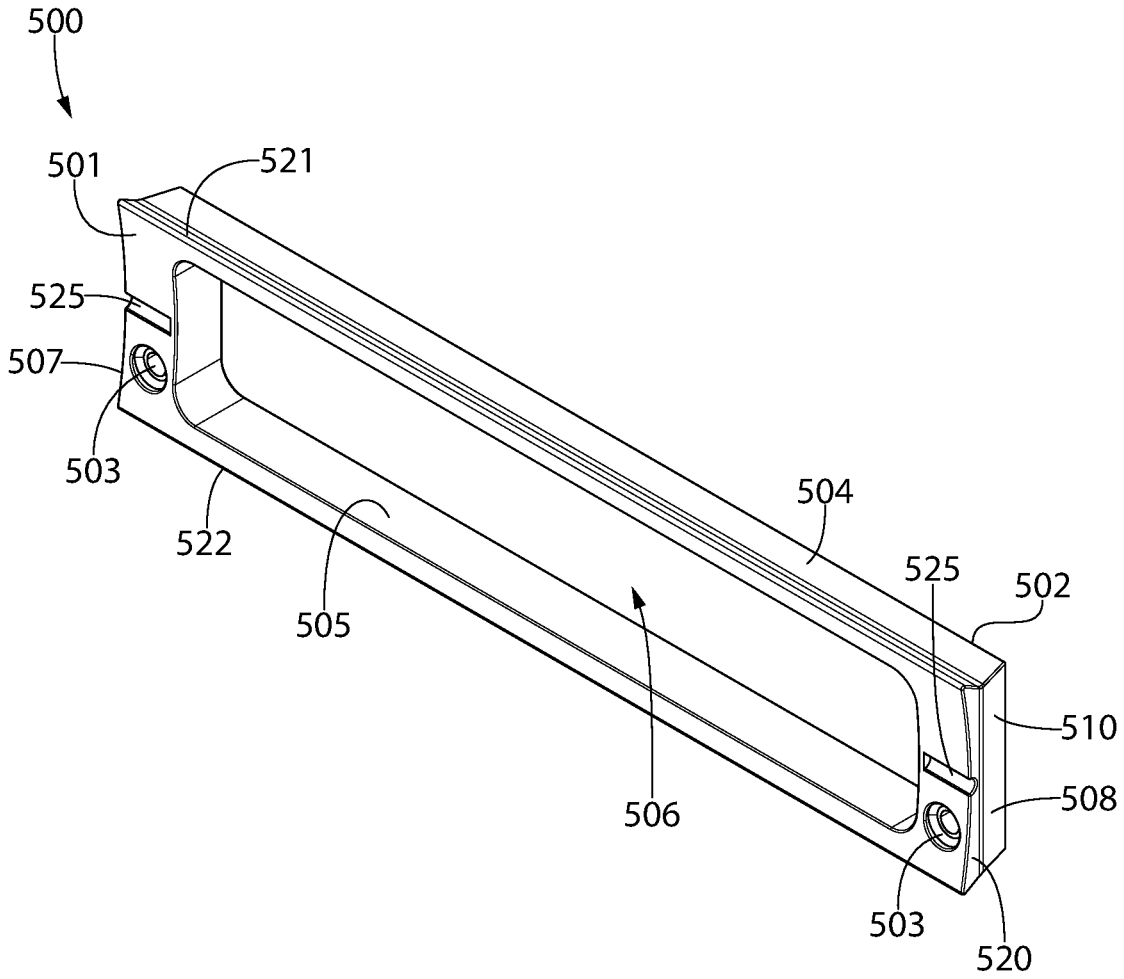
FIG. 17 is a perspective view of a mounting bracket in accordance with another embodiment of the present invention.
Figure 18A:
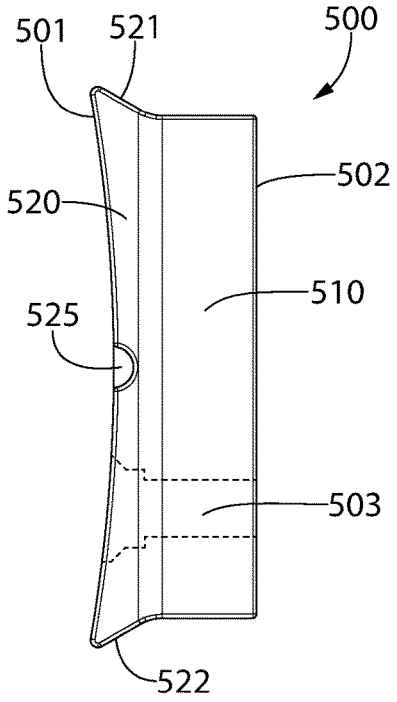
FIG. 18A is a side view of the mounting bracket of FIG. 17.
Figure 18B:
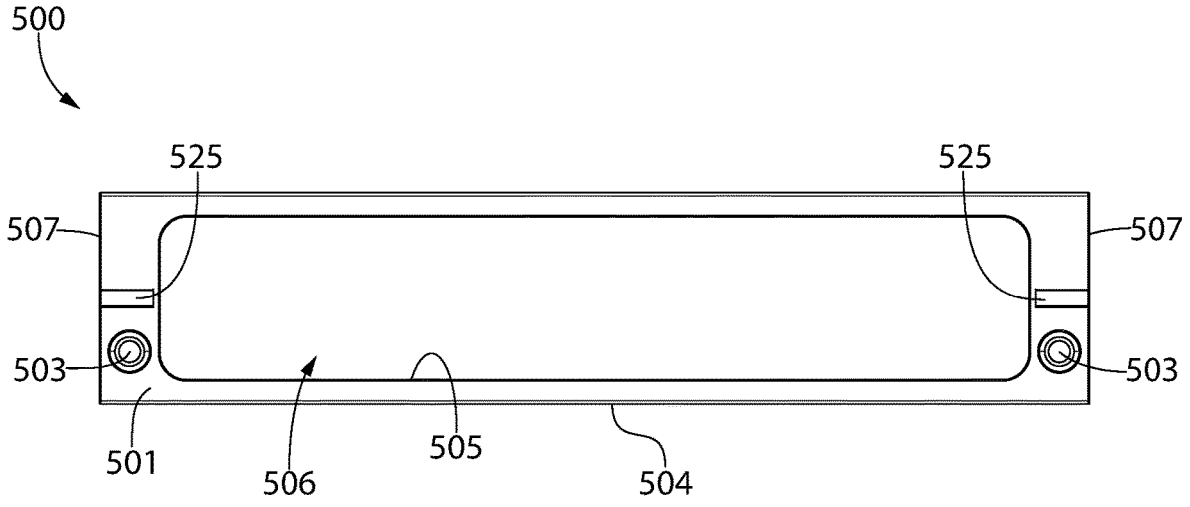
FIG. 18B is a front view of the mounting bracket of FIG. 17.

Referring to FIGS. 17, 18A, and 18B, a mounting bracket 500 is illustrated in accordance with another embodiment of the present invention. The mounting bracket 500 comprises a front surface 501 and a rear surface 502. The front surface 501 may be concave and the rear surface 502 may be planar. The mounting bracket 500 comprises a pair of openings 503 extending from the front surface 501 to the rear surface 502. The openings 503 may be configured to receive a fastener such as a screw for purposes of mounting the mounting bracket 500 to a wall. The mounting bracket 500 may comprise a standoff portion 510 and a connection portion 520. The standoff portion 510 may comprise the rear surface 502 and the connection portion 520 may extend from the standoff portion 510 to the front surface 501. In some embodiments, the standoff portion 510 may be omitted such that the mounting bracket 500 may comprise only the connection portion 520.

The mounting bracket 500 is in the form of a frame and comprises an outer surface 504 and an inner surface 505. In the exemplified embodiment, the inner surface 505 of the mounting bracket 500 surrounds an opening 506. However, the invention is not to be so limited in all embodiments and the mounting bracket 500 may be a solid structure such that the opening 506 may be omitted. However, the opening 506 decreases the amount of material needed to form the mounting bracket 500, thereby decreasing manufacturing costs. The mounting bracket 500 is elongated from a first end 507 to a second end 508.

The connection portion 520 comprises the front surface 501 and a portion of the inner and outer surfaces 504, 505. The connection portion 520 comprises first and second side portions 521, 522 that extend from the first end 507 to the second end 508. The first and second side portions 521, 522 diverge from one another with increasing distance from the standoff 510 towards the front surface 501 of the mounting bracket 500. Thus, the connection portion 520 may have a trapezoidal shape, so as to form a pin of a dovetail joint when the mounting bracket 500 is slidably coupled to one of the rack components 300.

The connection portion 520 may comprise first and second grooves 525 formed into he front surface 501. One of the grooves 525 may extend from the first end 507 inwardly towards the opening 506 and the other one of the grooves 525 may extend from the second end 508 inwardly towards the opening 506. The grooves 525 may be elongated in the same direction as the mounting bracket 500.

Figure 19:
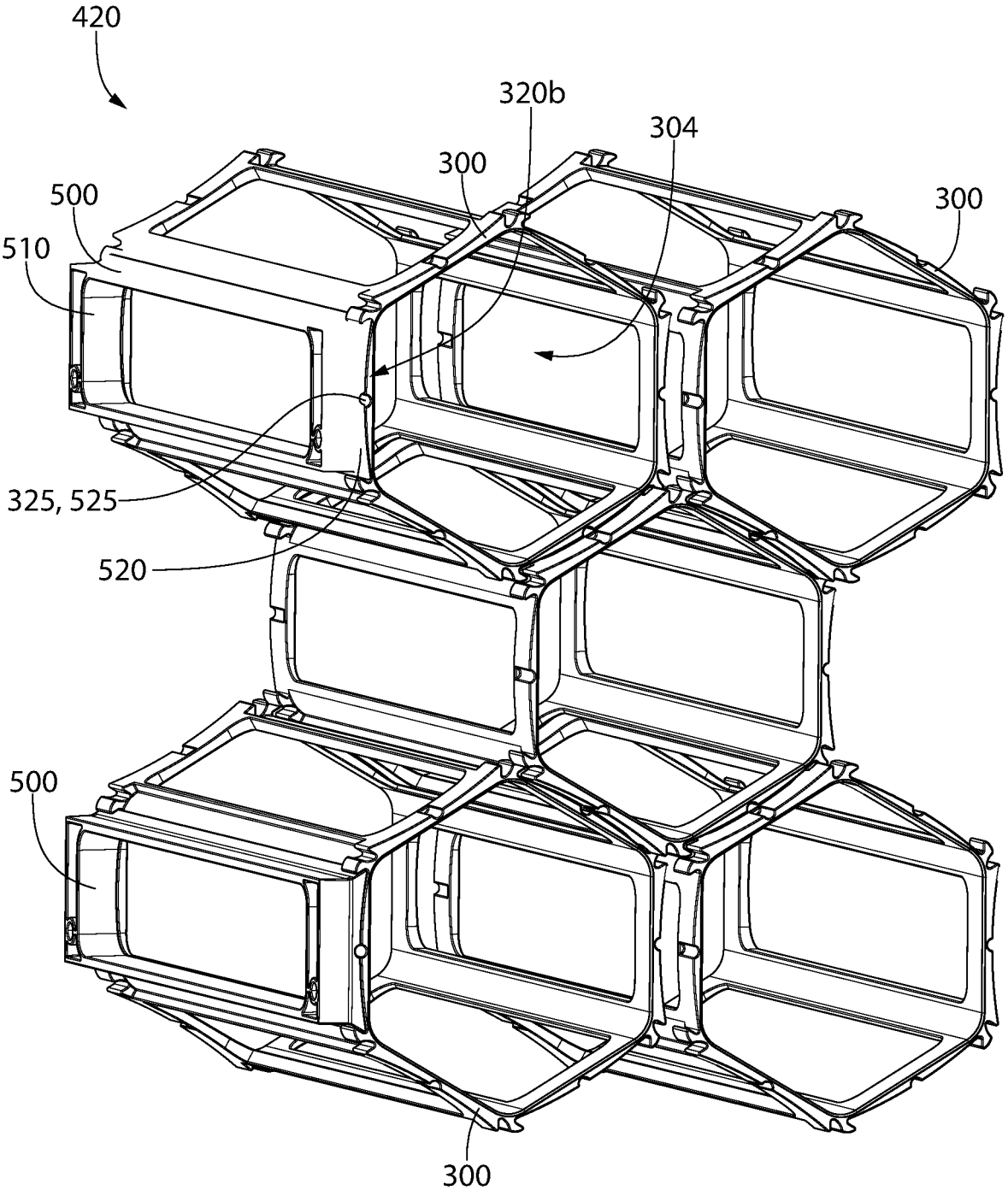
FIG. 19 is a perspective view of a bottle rack formed by coupling a plurality of the rack components of FIG. 10 together with one of the mounting brackets of FIG. 17 coupled thereto.

FIG. 19 illustrates two of the mounting brackets 500 being coupled to the bottle rack 420 which is formed by slidably coupling a plurality (five in this example) of the rack components 300 together. Each of the mounting brackets 500 may be slidably coupled to one of the connection features 320*b* of one of the rack component 300. Of course, the structure of the connection portion 520 of the mounting bracket 500 could be modified so that it is configured to be slidably coupled to one of the connection features 320*a* of one of the rack components 300 in other embodiments. Nonetheless, in the exemplified embodiment, the connection portion 520 of the mounting bracket 500 is aligned with one of the connection features 520*b* (which is a female type connection feature) of one of the rack components 300. The mounting bracket 500 is then slidably moved relative to the rack component 300 (or the rack component 300 is slidably moved relative to the mounting bracket 500) to nest the connection portion 520 of mounting bracket 500 within the socket defined by the connection feature 320*a*. When the mounting bracket 500 is coupled to the rack component 300, the groove 525 of the mounting bracket 500 may be aligned with one of the grooves 325 of the rack component 300 to form a boss for receiving a fastener such as a screw to securely couple the mounting bracket 500 to the rack component 300. The standoff portion 510 of the mounting bracket 500 somewhat protrudes from the bottle rack 420 so that when the system is mounted to the wall the rack components 300 are spaced from the wall to allow for easier insertion and removal of bottles form the cavities 304 thereof.

Figure 20A:
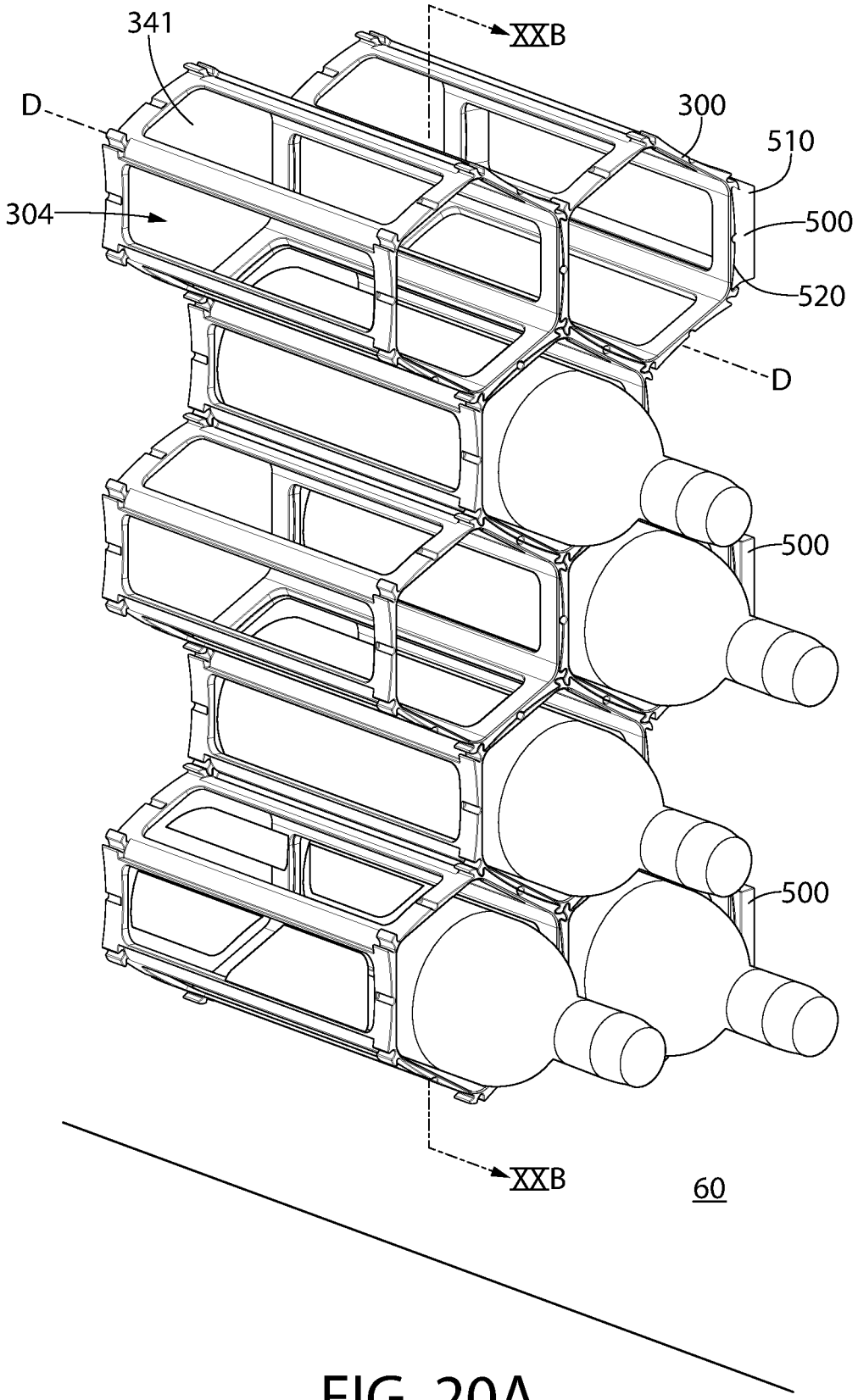
FIG. 20A is another perspective view of a bottle rack formed by coupling a plurality of the rack components of FIG. 10 together with one of the mounting brackets of FIG. 17 coupled thereto.
Figure 20B:
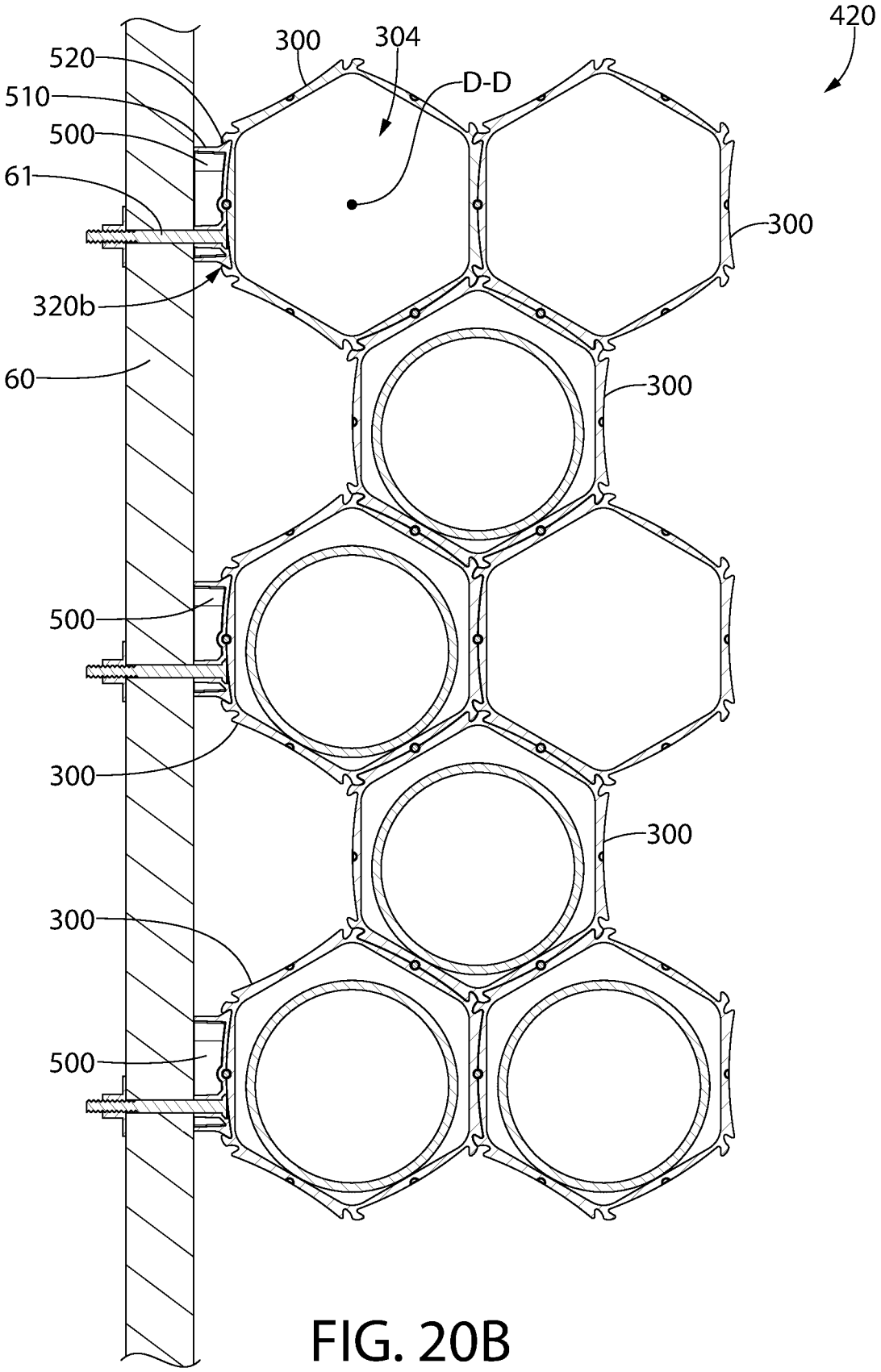
FIG. 20B is a cross-sectional view taken along line XX of FIG. 20A.

Because the openings 503 in the mounting bracket 500 are hidden by the rack component 300 when they are coupled, the mounting bracket 500 may need to be mounted to the wall prior to slidably coupling the rack component 300 (and the bottle rack 420) to the mounting bracket 500. FIGS. 20A and 20B illustrate the bottle rack 420 mounted to the wall 60 via the mounting bracket 500. Thus, the mounting brackets 500 may first be mounted to the wall 60, and then the bottle rack 420, or at least a rack component 300 thereof, may be slidably coupled to the mounting bracket 500 in the manner described herein.

As best shown in FIG. 20B, fasteners 61 extend through the openings 503 in the mounting brackets 500 to mount the mounting brackets 500 to the wall 60. FIG. 20B also best illustrates the engagement between the connection portions 510 of the mounting brackets 500 and the connection features 320*b* of the rack components 300.

When the bottle rack 420 is mounted to the wall 60 using the mounting brackets 500, the cavities 304 of the rack components 300 extend along a cavity axis D-D that is parallel to the outer surface of the wall 60. Thus, the bottles that are held within the cavities 304 of the rack components 300 are held in a label-forward orientation. This means that the labels are facing outwards, rather than the cork. Furthermore, due to the inclusion of the windows 341 in the rack components 300, the labels are readily viewable and the bottles are therefore readily identifiable.

Figure 21A:
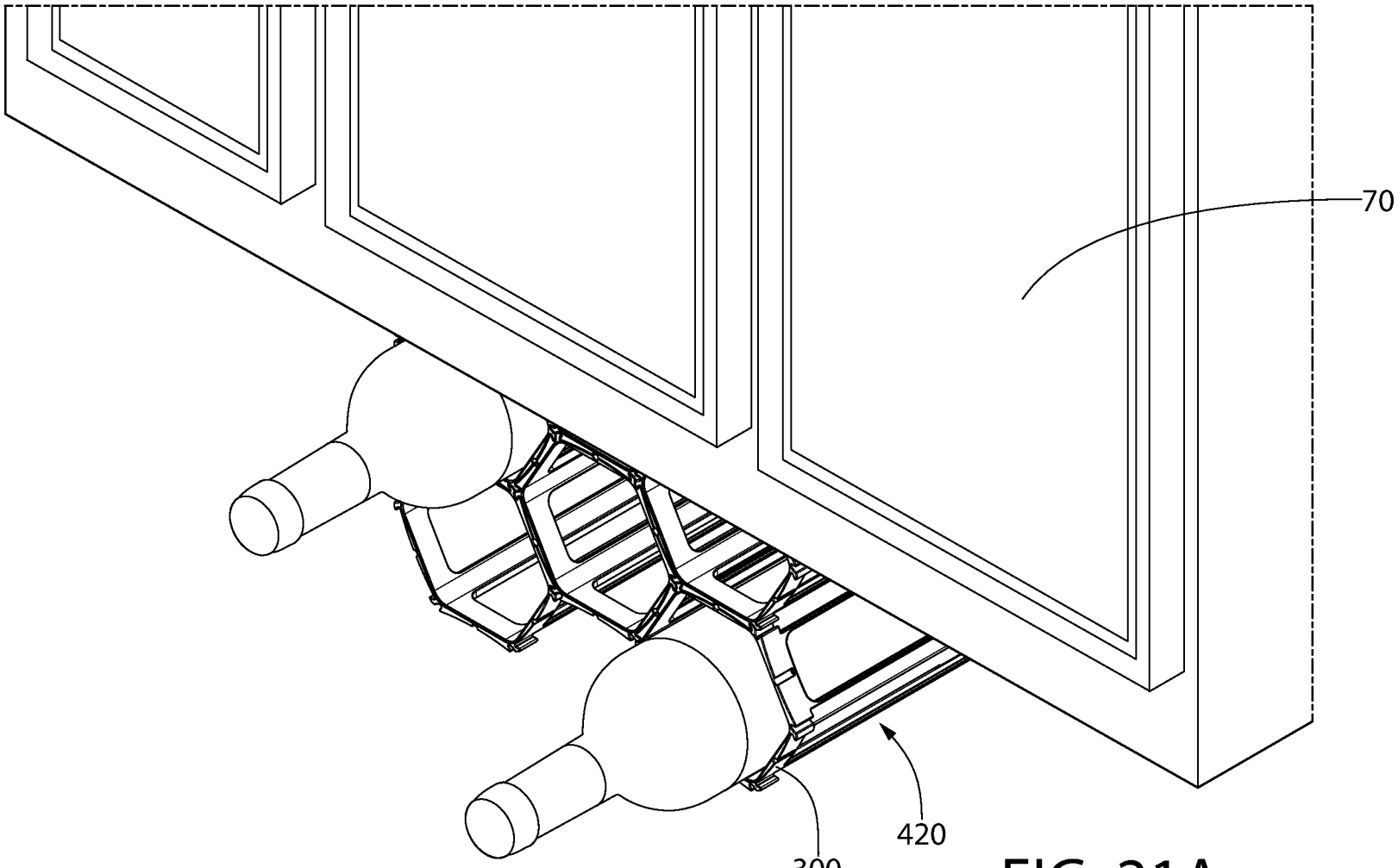
FIGS. 21A and 21B are perspective views of a bottle rack with one of the mounting brackets of FIG. 17 being used to mount the bottle rack beneath a cabinet in various orientations.
Figure 21B:
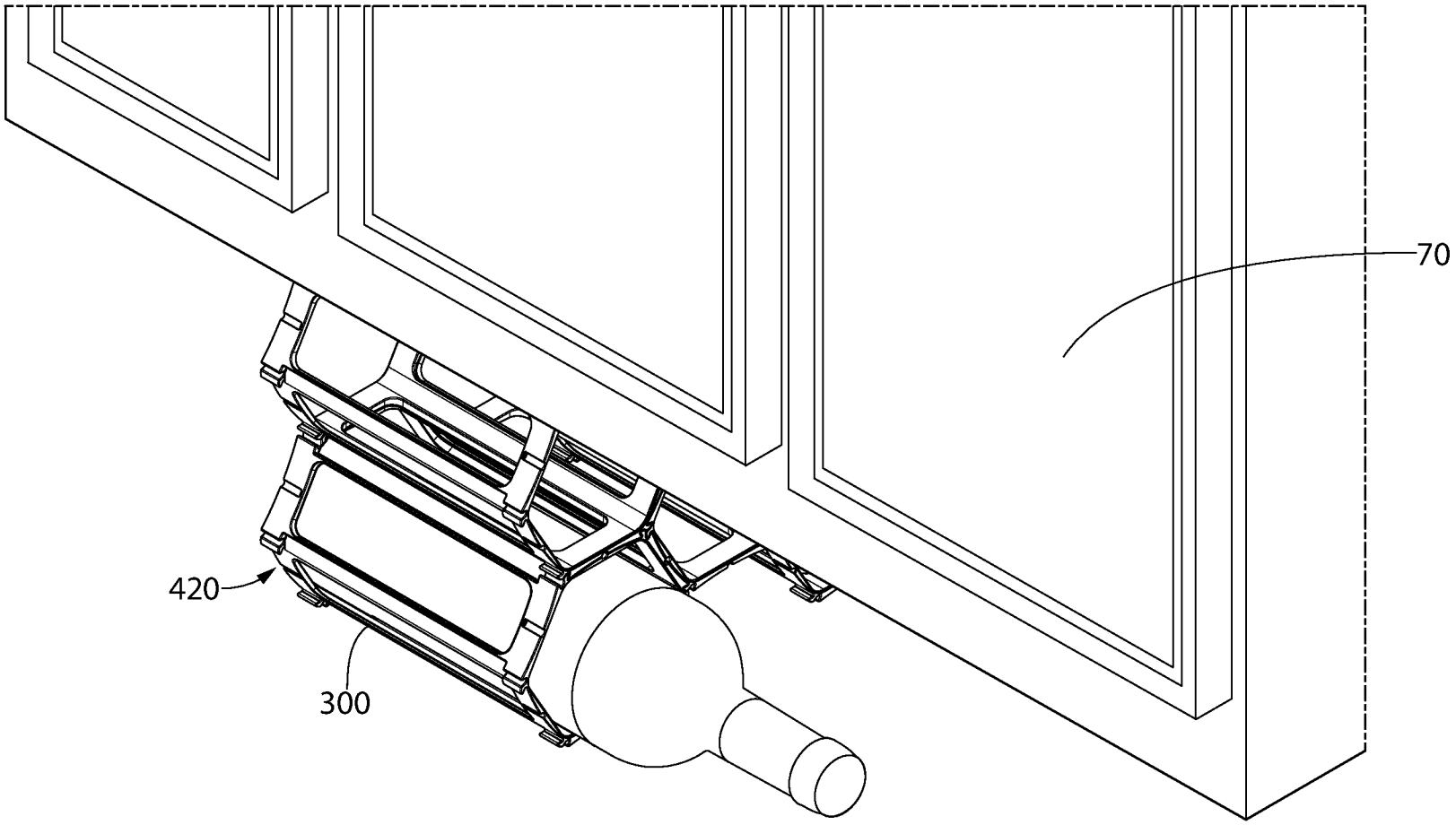

FIGS. 21A and 21B depict the bottle rack 420 being mounted below a cabinet 70 using the mounting brackets 500. That is, the mounting brackets 500 can be mounted directly to the underside of the cabinet 70 in a desired orientation, and then the rack components 300 can be coupled to the mounting bracket 500 and to one another to form the bottle rack 420. The mounting bracket 500 may be mounted to the underside of the cabinet 70 so that the bottles are stored in a cork-forward orientation as shown in FIG. 21A. Alternatively, the mounting bracket 500 may be mounted to the underside of the cabinet 70 so that the bottles are stored in a label-forward orientation as shown in FIG. 21B. Although the mounting bracket 500 is not visible in FIGS. 21A and 21B, the manner of its coupling to the underside of the cabinet 70 and to the bottle rack 420 should be readily understood from the description provided above.

While the mounting brackets 400, 450, 500 have been illustrated and described as being used with the bottle racks formed from the rack components 300, the invention is not to be so limited in all embodiments. The mounting brackets 400, 450, 500 may also be capable of being used with bottle racks formed by coupling several of the rack components 100 or the rack components 200 together. The mounting brackets 400, 450, 500 may be coupled to the rack components 100, 200 and/or the bottle racks formed therefrom in the same manner that the mounting brackets 400, 500 are coupled to the rack components 300.

In some embodiments, a modular bottle rack system may comprise a plurality of the rack components 100 or a plurality of the rack components 200 or a plurality of the rack components 300 and one or more of the mounting brackets 400 or 450 and one or more of the mounting brackets 500. This enables a user to decide whether to mount the bottle racks that the user forms in a cork forward orientation or in a label forward orientation. In other embodiments, the user may select which of the mounting brackets 400, 450, 500 that the user needs or wants at the time of purchase.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A modular bottle rack system comprising:

a plurality of rack components each comprising:

a first portion comprising a first wall, a second wall, and a common wall that collectively define a first receptacle that faces in a first direction;

a second portion comprising a third wall, a fourth wall, and the common wall that collectively define a second receptacle that faces in a second direction that is opposite the first direction;

wherein the first portion comprises a first male engagement feature and a first female engagement feature; and wherein the second portion comprises a second male engagement feature and a second female engagement feature; and wherein a first one of the plurality of rack components is configured to be coupled to a second one of the plurality of rack components during which the first male engagement feature engages the second female engagement feature and the first female engagement feature engages the second male engagement feature.

2. The modular bottle rack according to claim 1 wherein the first and second male and female engagement features are located along the first, second, third, and fourth walls.

3. The module bottle rack according to claim 1 wherein each of the plurality of rack components comprises an S-shaped transverse cross-sectional area.

* * * * *